US011025023B2

(12) United States Patent
Kohen

(10) Patent No.: US 11,025,023 B2
(45) Date of Patent: Jun. 1, 2021

(54) SMART QUICK CONNECT DEVICE FOR ELECTRICAL FIXTURES

(71) Applicant: Ran Roland Kohen, Aventura, FL (US)

(72) Inventor: Ran Roland Kohen, Aventura, FL (US)

( * ) Notice: Subject to any disclaimer, the term of this patent is extended or adjusted under 35 U.S.C. 154(b) by 0 days.

(21) Appl. No.: 16/443,207

(22) Filed: Jun. 17, 2019

(65) Prior Publication Data

US 2019/0312396 A1 Oct. 10, 2019

Related U.S. Application Data

(63) Continuation of application No. 15/573,606, filed as application No. PCT/US2016/032170 on May 12, 2016, now Pat. No. 10,326,247.

(Continued)

(51) Int. Cl.
*H01R 33/20* (2006.01)
*H01R 13/625* (2006.01)

(Continued)

(52) U.S. Cl.
CPC ..... *H01R 33/205* (2013.01); *H01R 13/625* (2013.01); *H01R 13/665* (2013.01);

(Continued)

(58) Field of Classification Search
CPC .... H01R 33/20; H01R 33/205; H01R 13/625; H01R 13/6276; H01R 13/665;

(Continued)

(56) References Cited

U.S. PATENT DOCUMENTS 484,911 A 10/1892 Green
1,595,972 A 8/1926 DeReamer (Continued)

FOREIGN PATENT DOCUMENTS

CN 1582518 A 2/2005
CN 1728475 A 2/2006

(Continued)

OTHER PUBLICATIONS

International Search Report with Written Opinion dated Aug. 13, 2018 for PCT/US2018/030372.
Office Action dated Sep. 25, 2018 from Chinese Patent Office for Application No. 201580063483.2.
Response filed Jan. 17, 2019, in U.S. Appl. No. 15/573,606.
Chinese Search Report dated Feb. 18, 2019 for Patent Application No. 2016800404661.
First Office Action dated Feb. 27, 2019 from Chinese Patent Office for Patent Application No. 201680040466.1.
IAEI, When continuity snaps, May-Jun. 2015.
IAEI, Supports reinforce our safety, Hanging Support Systems, Mar.-Apr. 2015.

(Continued)

*Primary Examiner* — Oscar C Jimenez
(74) *Attorney, Agent, or Firm* — Fleit Intellectual Property Law; Paul D. Bianco; Gary S. Winer

(57) ABSTRACT

A device for connecting an electrical fixture with electrical power supply wiring, and for mounting the fixture on a support includes a plug, a socket, and a sensing unit for at least one of wirelessly communicating a sensed condition and wirelessly receiving a signal, with the sensing unit electrically coupled to at least one of the plug and socket. The socket includes a socket body having at least one internal cavity therein with an electrically conductive contact terminal disposed within the cavity for establishing an electrical connection between the electrical power supply wiring and the socket. The plug is rigidly fixed to the fixture and insertable into the socket, with the plug having at least one male connector electrically connected to the fixture and engageable with the contact terminal within the socket to establish a circuit between the electrical fixture and the electrical power wiring. A releasable latch is carried on the combination of the plug and the socket for releasably mounting the fixture on the support.

21 Claims, 25 Drawing Sheets

Related U.S. Application Data

(60) Provisional application No. 62/308,718, filed on Mar. 15, 2016, provisional application No. 62/160,585, filed on May 12, 2015.

(51) Int. Cl.
*H01R 13/66* (2006.01)
*H01R 13/703* (2006.01)
*H01R 35/04* (2006.01)

(52) U.S. Cl.
CPC ..... *H01R 13/6658* (2013.01); *H01R 13/6683* (2013.01); *H01R 13/7038* (2013.01); *H01R 35/04* (2013.01)

(58) Field of Classification Search
CPC ..... H01R 13/6658; H01R 13/6683; H01R 13/7038; H01R 35/04; F21V 23/06; F21V 21/02
See application file for complete search history.

(56) References Cited

U.S. PATENT DOCUMENTS 1,897,954 A 2/1933 D'Olier
2,077,587 A 4/1937 Rowe
2,308,016 A 1/1943 Mihalyi
2,313,481 A 3/1943 Rendano
2,494,428 A 1/1950 Buck
2,673,966 A 3/1954 Larkin
2,726,372 A 12/1955 Appleton
2,728,895 A 12/1955 Quackenbush
2,863,037 A 12/1958 Johnstone
3,056,035 A 9/1962 Bernheim
3,118,713 A 1/1964 Ellis
3,159,444 A 12/1964 Stine
3,193,636 A 7/1965 Daniels
3,386,071 A 5/1968 Allen
3,398,260 A 8/1968 Martens
3,521,216 A 7/1970 Tolegian
3,585,564 A 6/1971 Skjervoll
3,648,002 A 3/1972 Du Rocher
3,651,443 A 3/1972 Quilez
3,668,603 A 6/1972 Burgess et al.
3,798,584 A 3/1974 Person
3,808,577 A 4/1974 Mathauser
3,813,478 A 5/1974 Ervin
3,855,564 A 12/1974 Dumas
3,871,732 A 3/1975 Appleton
4,059,327 A 11/1977 Vann
4,079,244 A 3/1978 Bortoluzzi
4,083,619 A 4/1978 McCormick et al.
4,107,770 A 8/1978 Weber
4,133,594 A 1/1979 Laverick et al.
4,335,927 A 6/1982 Allen et al.
4,448,388 A 5/1984 Dennis
4,462,653 A 7/1984 Flederbach
4,473,869 A 9/1984 De Widt
4,588,248 A 5/1986 Moore
4,629,843 A 12/1986 Kato et al.
4,631,648 A 12/1986 Nilssen
4,681,385 A 7/1987 Kruger et al.
4,753,600 A 6/1988 Williams
5,003,128 A 3/1991 Grondin
5,034,869 A 7/1991 Choi
5,173,053 A 12/1992 Swanson et al.
5,250,874 A 10/1993 Hall et al.
5,352,122 A 10/1994 Speyer
5,362,122 A 11/1994 Reihl et al.
5,438,216 A 8/1995 Juskey et al.
5,442,532 A 8/1995 Boulos et al.
5,442,632 A 8/1995 Boulos et al.
5,494,325 A 2/1996 Liu et al.
5,494,326 A 2/1996 Hinds
5,536,685 A 7/1996 Burward-Hoy
5,551,882 A 9/1996 Whiteman
5,562,458 A 10/1996 Stora et al.
5,584,726 A 12/1996 Le Gallic
5,600,537 A 2/1997 Gordin
5,622,873 A 4/1997 Kim et al.
5,668,920 A 9/1997 Pelonis
5,710,541 A 1/1998 Stanley
5,754,408 A 5/1998 Derouiche
5,777,391 A 7/1998 Nakamura et al.
5,790,381 A 8/1998 Derouiche et al.
5,803,590 A 9/1998 Wedell et al.
5,808,556 A 9/1998 Nelson
5,836,781 A 11/1998 Hyzin
5,952,714 A 9/1999 Sano et al.
5,962,810 A 10/1999 Glenn
6,064,155 A 5/2000 Maya
6,068,490 A 5/2000 Salzberg
6,093,029 A 7/2000 Kwon et al.
6,129,598 A 10/2000 Yu et al.
6,135,800 A 10/2000 Majors
6,170,967 B1 1/2001 Usher et al.
6,175,159 B1 1/2001 Sasaki
6,240,247 B1 5/2001 Reiker
6,241,559 B1 6/2001 Taylor
6,332,794 B1 12/2001 Tzeng Jeng
6,340,790 B1 1/2002 Gordin et al.
6,364,716 B1 4/2002 Seo
6,366,733 B1 4/2002 Reiker
6,398,392 B2 6/2002 Gordin et al.
6,422,722 B1 7/2002 Voltolina
6,517,223 B2 2/2003 Hsu
6,595,782 B1 7/2003 Hsiao
6,598,990 B2 7/2003 Li
6,631,243 B2 10/2003 Reiker
6,648,488 B1 11/2003 Pearce
6,751,406 B2 6/2004 Reiker
6,793,383 B2 9/2004 Wu
6,821,089 B2 11/2004 Bilskie
6,837,754 B1 1/2005 Walton
6,962,498 B2 11/2005 Kohen
7,001,199 B1 2/2006 Badalpour
7,052,301 B2 5/2006 Garcia et al.
7,066,739 B2 6/2006 McLeish
7,192,303 B2 3/2007 Kohen
7,462,066 B2 12/2008 Kohen
7,467,881 B2 12/2008 McMillen
7,569,710 B1 8/2009 Ozero
7,706,757 B2 4/2010 Luglio et al.
7,723,862 B1 5/2010 Spillman et al.
7,878,691 B2 2/2011 Liang
8,123,378 B1 2/2012 Ruberg et al.
8,186,852 B2 5/2012 Dassanayake et al.
8,192,057 B2 6/2012 Dassanayake et al.
8,277,082 B2 10/2012 Dassanayake et al.
8,348,678 B2 1/2013 Hardisty
8,354,768 B2 1/2013 Cipriani
8,357,016 B2 1/2013 Schumacher
8,419,218 B2 4/2013 Dassanayake et al.
8,449,137 B2 5/2013 Dassanayake et al.
8,558,413 B1 10/2013 Lepard
D693,765 S 11/2013 Workman
8,702,435 B2 4/2014 Tajima
8,894,247 B2 11/2014 Kim et al.
8,979,347 B2 3/2015 Holman
9,328,910 B2 5/2016 Lin et al.
9,644,824 B2 5/2017 Dassanayake et al.
9,702,535 B2 7/2017 Dassanayake et al.
9,901,039 B1 2/2018 Dellerson et al.
9,903,576 B2 2/2018 Creasman et al.
10,208,977 B2 2/2019 Bhide
10,317,015 B2 6/2019 Joye
10,326,247 B2 6/2019 Kohen
2002/0060369 A1 5/2002 Akram
2002/0064380 A1 5/2002 Reiker
2002/0081107 A1 6/2002 Reiker
2003/0012027 A1 1/2003 Hsu
2003/0107891 A1 6/2003 Kohen
2004/0192415 A1* 9/2004 Luglio ..... H04B 1/38
455/575.1

(56) References Cited

U.S. PATENT DOCUMENTS

| | | | | |
|---|---|---|---|---|
| 2005/0148241 | A1 | 7/2005 | Kohen | |
| 2006/0044789 | A1 | 3/2006 | Curtis | |
| 2006/0141842 | A1 | 6/2006 | Sauer | |
| 2006/0146527 | A1* | 7/2006 | VanderSchuit | F21V 19/006 362/228 |
| 2007/0105414 | A1 | 5/2007 | Kohen | |
| 2007/0167072 | A1 | 7/2007 | Kohen | |
| 2007/0258202 | A1 | 11/2007 | Cooley et al. | |
| 2008/0146064 | A1 | 6/2008 | Bankstahl | |
| 2009/0035970 | A1 | 2/2009 | Kohen | |
| 2009/0111322 | A1 | 4/2009 | Roland | |
| 2009/0129974 | A1 | 5/2009 | McEllen | |
| 2009/0280673 | A1 | 11/2009 | Kohen | |
| 2010/0020550 | A1 | 1/2010 | Kawashima | |
| 2010/0214775 | A1 | 8/2010 | Liang | |
| 2010/0301769 | A1 | 12/2010 | Chemel et al. | |
| 2011/0060701 | A1 | 3/2011 | Verfuerth et al. | |
| 2011/0134239 | A1 | 6/2011 | Vadai et al. | |
| 2012/0196471 | A1* | 8/2012 | Guo | H01R 13/6276 439/345 |
| 2013/0040471 | A1 | 2/2013 | Gervais et al. | |
| 2013/0107536 | A1 | 5/2013 | Hiraoka | |
| 2014/0168944 | A1 | 6/2014 | Osada et al. | |
| 2014/0211487 | A1 | 7/2014 | Spiro | |
| 2014/0225731 | A1 | 8/2014 | Gouveia | |
| 2014/0263903 | A1 | 9/2014 | Ostrobrod | |
| 2014/0268790 | A1* | 9/2014 | Chobot | H05B 47/11 362/276 |
| 2015/0009666 | A1 | 1/2015 | Keng et al. | |
| 2015/0009676 | A1 | 1/2015 | Danesh | |
| 2015/0044040 | A1 | 2/2015 | Oda et al. | |
| 2015/0085500 | A1 | 3/2015 | Cooper | |
| 2016/0053952 | A1 | 2/2016 | Kuti et al. | |
| 2016/0069556 | A1 | 3/2016 | Li | |
| 2016/0123374 | A1 | 5/2016 | Roberts | |
| 2016/0131358 | A1 | 5/2016 | Spiro | |
| 2016/0255697 | A1 | 9/2016 | Bhide | |
| 2017/0105265 | A1 | 4/2017 | Sadwick | |
| 2017/0234319 | A1 | 8/2017 | Seccareccia | |
| 2017/0248148 | A1 | 8/2017 | Kohen | |
| 2018/0115131 | A1 | 4/2018 | Kohen | |
| 2020/0018469 | A1 | 1/2020 | Kohen | |
| 2020/0056773 | A1 | 2/2020 | Kohen | |
| 2020/0144766 | A1 | 5/2020 | Kohen | |

FOREIGN PATENT DOCUMENTS

| | | | |
|---|---|---|---|
| CN | ZL 01 8 23877.7 | | 11/2007 |
| CN | 10195268 | A | 12/2007 |
| CN | 101095268 | A | 12/2007 |
| CN | 102483213 | A | 5/2012 |
| CN | 102870307 | A | 1/2013 |
| CN | 104033399 | A | 9/2014 |
| CN | 203934061 | U | 11/2014 |
| CN | 204879746 | U | 12/2015 |
| CN | 107211515 | A | 9/2017 |
| DE | 19849101 | A1 | 4/1999 |
| DE | 29923352 | U1 | 8/2000 |
| DE | 20203467 | U1 | 6/2002 |
| EP | 0704934 | A2 | 4/1996 |
| EP | 1024559 | A2 | 8/2000 |
| EP | 1456914 | A1 | 9/2004 |
| EP | 1789984 | A2 | 5/2007 |
| EP | 3295525 | A1 | 5/2016 |
| IL | 126246 | | 8/2001 |
| JP | 2008166071 | A | 7/2008 |
| RU | 2011122686 | | 10/2012 |
| RU | 2526853 | | 8/2014 |
| WO | 00/16442 | | 3/2000 |
| WO | 01/01047 | A1 | 1/2001 |
| WO | 03/044906 | A1 | 5/2003 |
| WO | 2005053100 | A2 | 6/2005 |
| WO | 2005/074087 | A1 | 8/2005 |
| WO | 2006031853 | A2 | 3/2006 |
| WO | 2006/060772 | A2 | 6/2006 |
| WO | 2006060772 | A2 | 6/2006 |
| WO | 2011/005526 | A2 | 1/2011 |
| WO | 2011/020231 | A1 | 2/2011 |
| WO | 2011/134709 | A2 | 3/2011 |
| WO | 2011/134709 | A2 | 11/2011 |
| WO | 2012/167320 | A1 | 12/2012 |
| WO | 2016054159 | A1 | 4/2016 |
| WO | 2016/144795 | A1 | 9/2016 |
| WO | 2016/183354 | | 11/2016 |
| WO | 2016/183354 | A1 | 11/2016 |
| WO | 2016183354 | A1 | 11/2016 |
| WO | 2018/165646 | | 9/2018 |
| WO | 2018/165058 | | 10/2018 |
| WO | 2018/195068 | | 10/2018 |

OTHER PUBLICATIONS

International Search Report dated Jul. 18, 2016 for International Application No. PCT/US2016/032170 filed May 12, 2016.

Written Opinion for for International Application No. PCT/US2016/032170 filed May 12, 2016.

Second Office Action for Chinese Patent Application No. 201580063483.2, dated Jun. 14, 2019 (with translation of cover page).

European Search Report for Application No. 16793548.5 dated Feb. 14, 2019.

International Search Report with Written Opinion dated Jul. 6, 2018 for PCT/US2018/027956.

Office Action dated Sep. 18, 2018 in U.S. Appl. No. 15/573,606.

International Search Report for PCT/IL99/00499 filed Sep. 14, 1999.

European Search Report for EP 01 27 4757 dated Mar. 28, 2006.

Australian Examiner's First Report on Patent Application AU 2002221000.

Indian First Examination Report dated Jun. 24, 2010 for Indian Application No. 1677/KOLNP/2006.

New Zealand Examination Report for NZ Patent Application No. 533697 dated May 9, 2007.

For Chinese Patent Application No. 01823877.7: Notice of Allowance dated Oct. 17, 2006 Second Office Action dated Apr. 6, 2007 First Office Action dated Jul. 4, 2006.

English translation of Search Report from Chinese Patent Office for Application No. 201580063483.2 dated Sep. 11, 2018.

Office Action from Chinese Patent Office for Application No. 201580063483.2 dated Sep. 25, 2018 (with English translation).

Publication issued in the Official Gazette from Mexican Patent Application MX/a/2017/004137 dated Feb. 13, 2018, 3 pages.

International Search Report and Written Opinion for PCT/US2018/21919 filed Mar. 12, 2018.

International Search Report and Written Opinion for PCT/US2018/20987 filed Mar. 5, 2018.

European Search Report dated Jul. 3, 2018 for Application No. 15846948.6.

International Search Report, Written Opinion, International Preliminary Report on Patentability for PCT/US2004/039399 filed Nov. 22, 2004.

International Search Report, Written Opinion, International Preliminary Report on Patentability for PCT/US2005/032661 filed Sep. 14, 2005.

International Search Report, Written Opinion, International Preliminary Report on Patentability for PCT/US2005/043934 filed Dec. 2, 2005.

International Search Report, Written Opinion, International Preliminary Report on Patentability for PCT/US2015/53138 filed Sep. 30, 2015.

International Search Report and Written Opinion for PCT/US2016/32170 filed May 12, 2016.

European Search Report for EP05796234 dated Nov. 5, 2007 (realted to WO2006031853).

International Search Report for PCT/IL01/01078 filed Nov. 22, 2001.

(56) References Cited

OTHER PUBLICATIONS

International Preliminary Report on Patentability dated Nov. 14, 2017 for International Application No. PCT/US2016/032170 filed May 12, 2016.
Office Action dated Sep. 25, 2014 from Chinese Patent Office for Application No. 201580063483.2.
Notice of Allowance dated Jul. 8, 2020 for U.S. Appl. No. 16/609,875.
For Russian Patent Application 2017142137 (national Stage of PCT/US2016/032170): Prosecution history including decision to grant dated Oct. 25, 2019.
Office Action issued by the European Patent Office dated Dec. 19, 2019 for Application No. 16 793 548.5-1201.
Office Action for U.S. Appl. No. 15/515,664, dated Sep. 10, 2019.
International Preliminary Report on Patentability dated Sep. 10, 2019 for PCT/US2018/020987, filed Mar. 5, 2018.
International Search Report dated Jul. 6, 2018 for PCT/US2018/027956 filed Apr. 17, 2018.
Written Opinion dated Jul. 6, 2018 for PCT/US2018/027956 filed Apr. 17, 2018.
International Search Report dated May 17, 2018 for PCT/US2018/021919 filed Mar. 12, 2018.
Witten Opinion for PCT/US2018/021919 filed Mar. 12, 2018.
International Preliminary Report on Patentability dated Sep. 10, 2019 for PCT/US2018/021919.
International Search Report dated Aug. 13, 2018 for PCT/US2018/030372 filed May 1, 2018.
Written Opinion dated Aug. 13, 2018 for PCT/US2018/030372 filed May 1, 2018.
International Preliminary Report on Patentability dated Oct. 22, 2019 for PCT/US2018/027956.
Office Action for U.S. Appl. No. 16/491,321, dated Apr. 21, 2020.
First Office Action dated Sep. 2, 2020 for Chinese Application No. 201880030051.5 with translation of cover page (12 pages).
Response to First Examination Report, filed Sep. 4, 2020 for Indian Patent Application No. 201717013438, National Stage of PCT/US2015/053138.
Office Action dated Aug. 3, 2020, for European Patent Application No. 16793548.5 (Regional Stage of PCT/US2016/032170).
For U.S. Appl. No. 16/605,994: Notice of Allowance dated Jun. 29, 2020.
First Examination Report dated Jun. 2, 2020 for Indian Patent No. 201717042509 filed Nov. 27, 2017.
International Preliminary Report on Patentability dated Nov. 5, 2019 for International Application No. PCT/US2018/030372 filed May 1, 2018, 6 pages.
Written Opinion for International Application No. PCT/US2018/030372 filed May 1, 2018, 5 pages.
For Chinese Patent Application No. 201580063483.2 (national stage of PCT/US2015/053138): Third Office Action, dated Sep. 18, 2019 (with English translation) Response to Third Office Action, dated Dec. 2, 2019 (13 pages).
For Chinese Patent Application No. 201580063483.2 (national stage of PCT/US2015/053138): Response to First Office Action, dated Feb. 11, 2019 (9 pages) Response to Second Office Action, dated Aug. 26, 2019 (12 pages).
For Chinese Patent Application No. 2016800404661 (national stage of PCT/US2016/032170): Second Office Action, dated Dec. 2, 2019 (3 pages) Search Report, dated Nov. 24, 2019 (2 pages).
For Indian Patent Application No. 201717013438 (National Stage of PCT/US2015/053138): First Examination Report, dated Dec. 13, 2019 (6 pages).
First Office Action dated Aug. 13, 2020 for Chinese Application No. 2018800295358.
Search Report dated Aug. 7, 2020 for Chinese Application No. 2018800295358.
Final Office Action for U.S. Appl. No. 15/515,664, dated Mar. 10, 2020.
International Search Report dated May 25, 2020 for PCT/US2020/019010 filed Feb. 20, 2020.
Written Opinion dated May 25, 2020 for PCT/US2020/019010 filed Feb. 20, 2020.

* cited by examiner

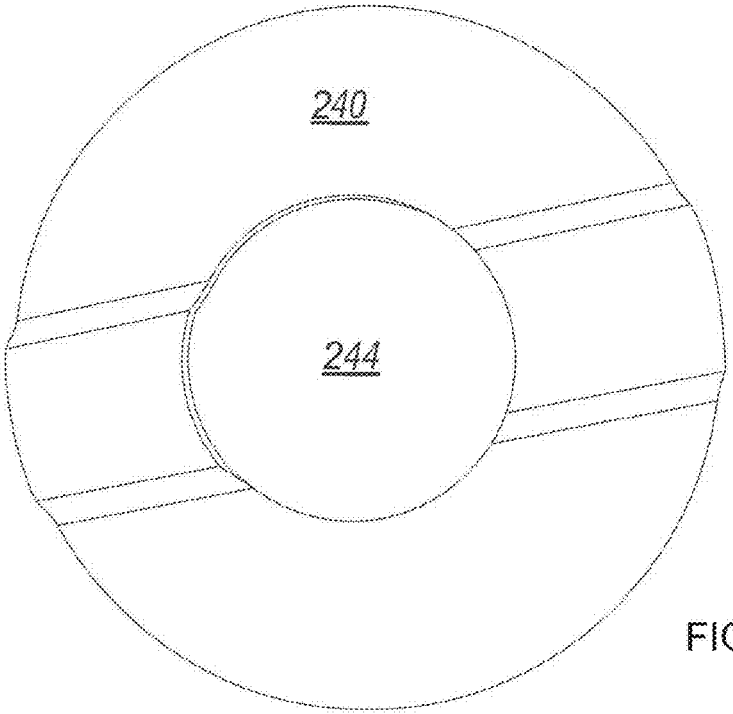
FIG. 19
FIG. 20
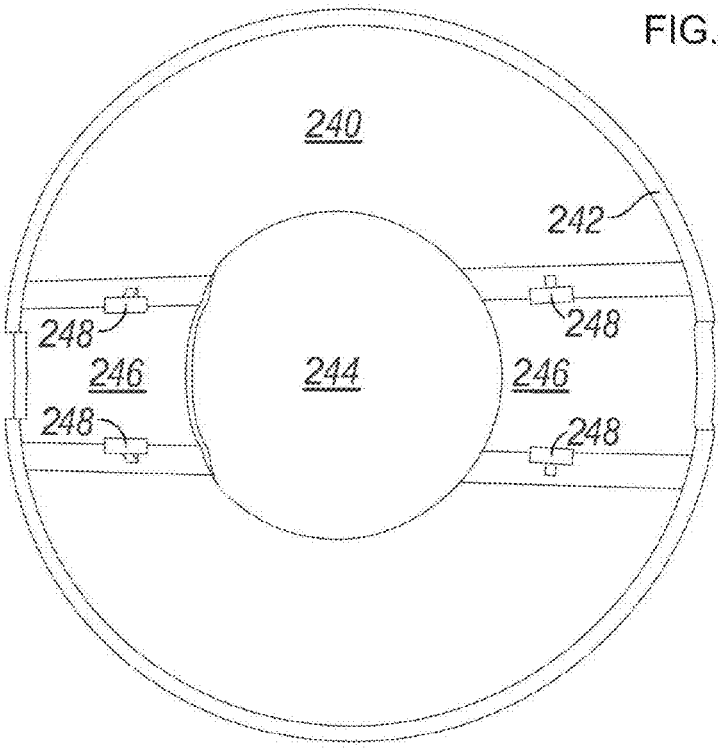

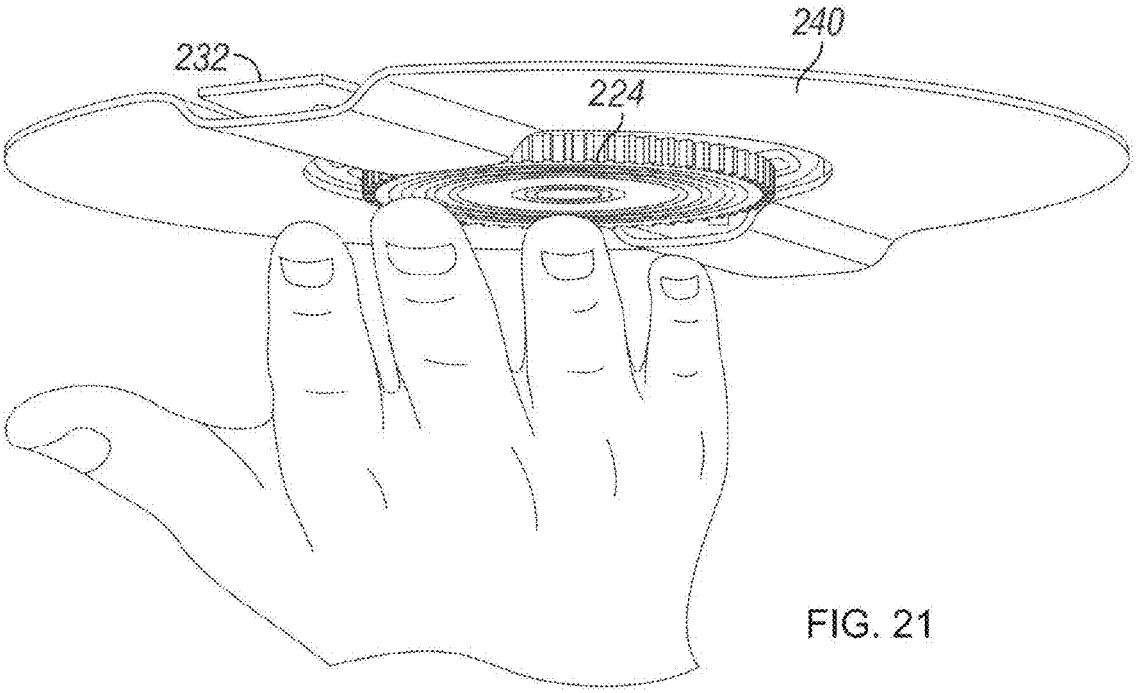
FIG. 21
FIG. 22
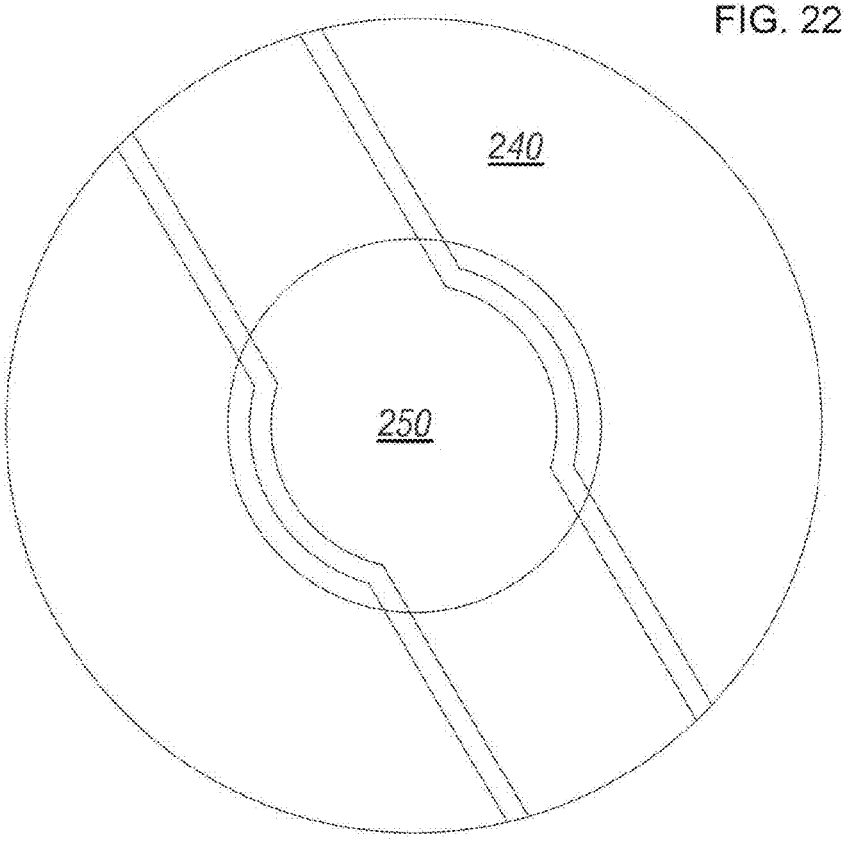

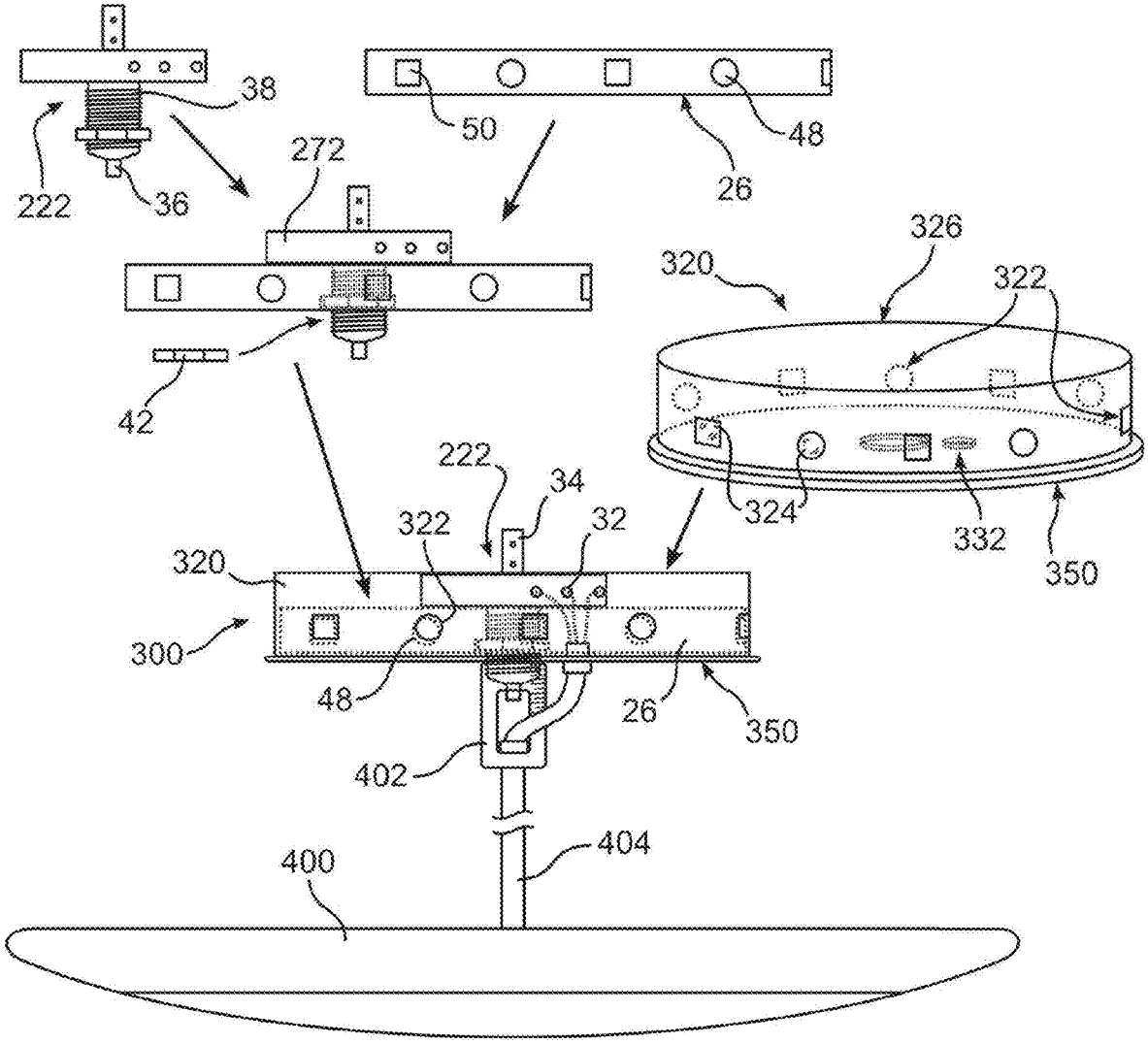
FIG. 38
FIG. 39
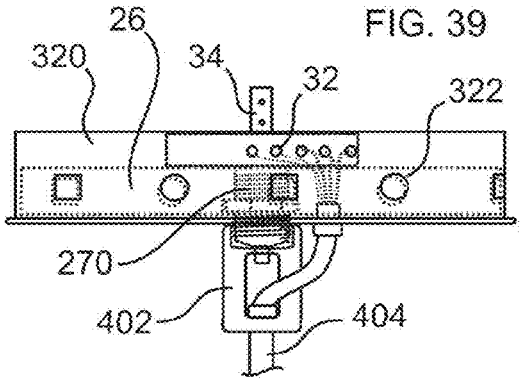
FIG. 40
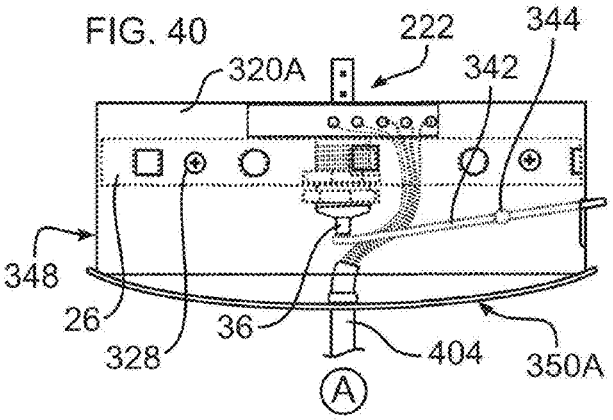

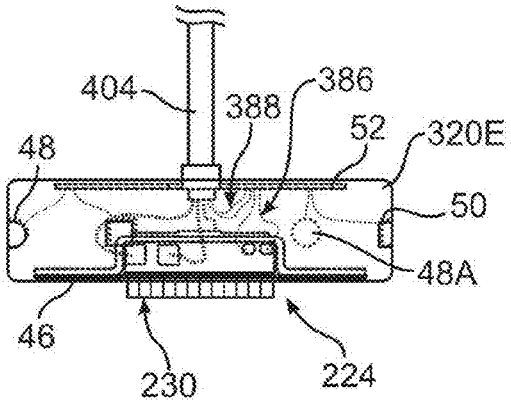
FIG. 46
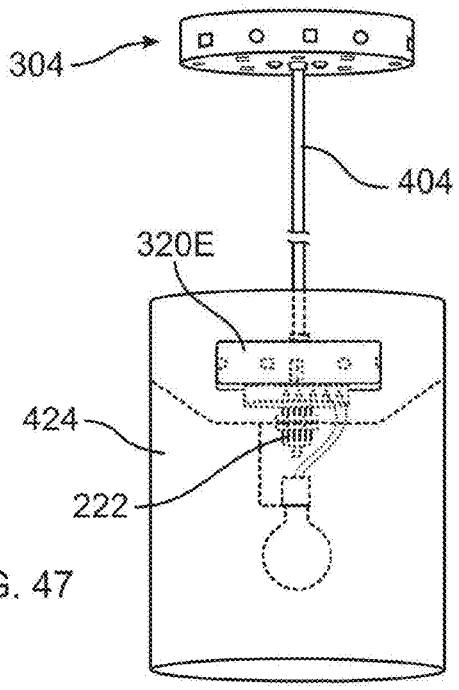
FIG. 47
FIG. 48
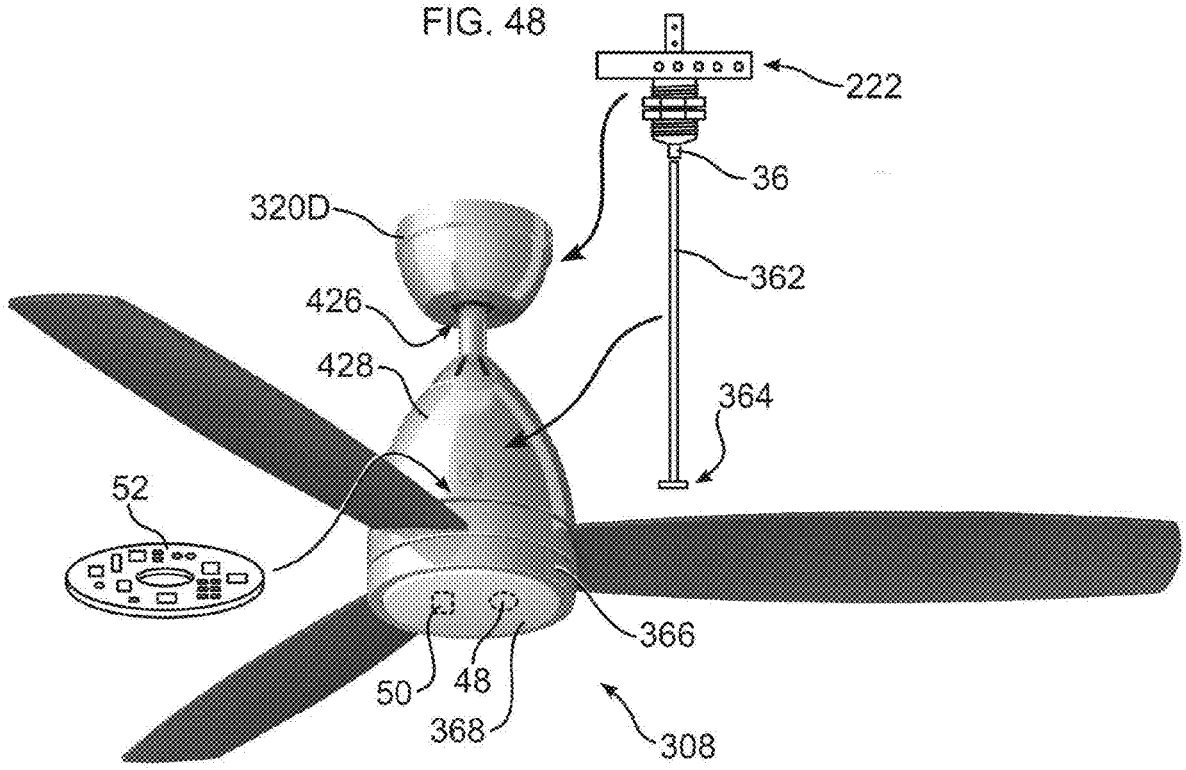

SMART QUICK CONNECT DEVICE FOR ELECTRICAL FIXTURES

CROSS-REFERENCE TO RELATED APPLICATIONS

This disclosure relates to U.S. Pat. No. 7,462,066 filed Mar. 20, 2007; U.S. Pat. No. 7,192,303 filed Dec. 2, 2004; and U.S. Pat. No. 6,962,498 filed Dec. 12, 2001; and to U.S. Patent Application Publication No. 20090280673 filed Dec. 2, 2005; U.S. Provisional Application 62/160,585 filed May 12, 2015; and U.S. Provisional Application 62/308,718, filed Mar. 15, 2016, the contents of all of which are hereby incorporated by reference herein, in their entirety.

FIELD OF THE DISCLOSURE

The disclosure relates to smart electrical connectors and fixtures, and more particularly to an electrical plug and socket combination enabling tool-less connection and mounting of electrical fixtures at electrical outlets, the connector and/or fixtures including electronic sensors, controls, and/or communication devices.

BACKGROUND OF THE DISCLOSURE

There are a number of commercially available systems termed 'smart-home environment' systems, which can include one or more sensors and network-connected devices. These smart-home devices can sometimes intercommunicate and integrate together within the smart-home environment. The smart-home devices may also communicate with cloud-based smart-home control and/or data-processing systems in order to distribute control functionality, to access higher-capacity and more reliable computational facilities, and to integrate a particular smart home into a larger, multi-home or geographical smart-home-device-based aggregation.

Techniques for installing electrical fixtures and appliances such as lighting fixtures and fans on walls or ceilings usually require the assistance of a qualified electrician, and the use of a variety of tools and specialized hardware. The procedure for installing or uninstalling such fixtures can also be relatively time consuming, even when performed by an experienced installer, and can be hazardous. In addition to the need for hand-wiring the necessary electrical connections between the fixture and electrical power supply wiring, the installer must make separate mechanical connections for supporting or suspending the fixture in place.

SUMMARY OF THE DISCLOSURE

A device for connecting an electrical fixture with electrical power supply wiring, and for mounting the fixture on a support includes a plug, a socket, and a sensing unit for at least one of wirelessly communicating a sensed condition and wirelessly receiving a signal, with the sensing unit electrically coupled to at least one of the plug and socket. The socket includes a socket body having at least one internal cavity therein with an electrically conductive contact terminal disposed within the cavity for establishing an electrical connection between the electrical power supply wiring and the socket. The plug is rigidly fixed to the fixture and insertable into the socket, with the plug having at least one male connector electrically connected to the fixture and engageable with the contact terminal within the socket to establish a circuit between the electrical fixture and the electrical power wiring. A releasable latch is carried on the combination of the plug and the socket for releasably mounting the fixture on the support.

In some embodiments, the sensing unit is electrically coupled to the plug, while in other embodiments, the sensing unit is mechanically coupled to the plug. The circuit between the electrical fixture and the electrical power wiring can be established through the sensing unit.

In some embodiments, the sensing unit wirelessly communicates a sensed condition. The sensing unit can wirelessly receive a signal. The signal can be a command signal to control the device and/or the associated electrical fixture. The command signal can result from the sensed condition or The command signal can be independent of the sensed condition.

In some embodiments, the sensing unit wirelessly receives a signal, which can be a command signal to control the device and/or the electrical fixture. The sensing unit can include a transmitting sensor for receiving at least one of an RF, Wi-Fi, and Bluetooth sensor.

The sensing unit can include an environmental sensor for determining an environmental condition. The environmental condition can include at least one of temperature, humidity, smoke, carbon monoxide, motion, and presence. The sensing unit can include a security sensor. The security sensor can include at least one of a security camera, glass breakage detector, motion/presence detector, and/or emergency lighting.

In some embodiments, the plug has a plurality of teeth and the socket has a plurality of teeth, with the plurality of teeth of the plug engaging the plurality of teeth of the socket to limit relative rotational movement of the plug and socket. The teeth can be located on opposing faces or on the circumference of the plug and socket.

Another aspect of the disclosure relates to a plug for coupling with a socket for a device for connecting an electrical fixture with electrical power supply wiring, and for mounting the fixture on a support, the plug rigidly fixable to the fixture. The plug includes: at least one male connector electrically connected to the fixture and engageable with a contact terminal within the socket to establish a circuit between the electrical fixture and the electrical power wiring; a releasable latch carried on the combination of the plug and the socket for releasably mounting the fixture on the support; and a sensing unit for at least one of wirelessly communicating a sensed condition and wirelessly receiving a signal, with the sensing unit electrically coupled to at least one of the plug and socket.

Another aspect of the disclosure relates to a device for connecting an electrical fixture, which includes: a first electrical plug including: a plug body, a plurality of concentric conductive rings connected to the body, a cylindrical post extending along an axis defined by the concentric rings, the post including an axially extending channel and at least one radially extending shaft housing a retaining ball, a plunger movable within the axially extending channel and having a radial profile which pushes the retaining ball to protrude from the axially extending channel in a first position, and which enables the retaining ball to retract into the channel to not protrude in a second position; at least one sensor electrically connected to at least one concentric conductive ring of the plug; an electrical wire having a plurality of conductors, the wire defining proximal and distal opposing ends, a conductor electrically connected to at least one of the concentric conductive rings at the proximal end; and an extension housing connected to the distal end of the conductor, the housing including a socket mateable with a second electrical plug as defined with respect to the first electrical plug, when a second electrical plug is inserted into the socket, the socket including: a channel sized to receive the cylindrical post of the second electrical plug, the channel defining a portion having a radius less than a radius defined by the post and a protruding retaining ball, the channel defining a portion have a radius that is not less than a radius defined by the post and a protruding retaining ball; a plurality of concentric channels mateable with the plurality of concentric rings; a plurality of electrical terminals each disposed proximate a concentric channel and positioned to electrically contact one of the concentric conductive rings when the concentric ring is mated within a concentric channel, at least one of the electrical terminals connected to a conductor of the electrical wire.

BRIEF DESCRIPTION OF THE DRAWINGS

A more complete understanding of the present disclosure, and the attendant advantages and features thereof, will be more readily understood by reference to the following detailed description when considered in conjunction with the accompanying drawings wherein:

FIG. 19 is a front view of an embodiment of a face plate according to the disclosure.

FIG. 20 is a back view of the face plate of FIG. 3.

FIG. 21 is a view of the face plate of FIGS. 3 and 4 installed.

FIG. 22 is a front view of a face plate with a face plate centerpiece.

FIG. 38 is an exploded view of an assembly of the disclosure including a plug and sensing array contained within a housing, the assembly connected to an electrical fixture.

FIG. 39 depicts the assembly of FIG. 38, wherein the plug includes additional connections for signal carrying wires.

FIG. 40 depicts the assembly of FIG. 39, however an alternate housing forms an extended canopy, the housing including a release lever.

FIG. 46 depicts the extension housing of FIG. 44, configured with sensors.

FIG. 47 is a perspective view of the assembly of FIG. 46 connected to an electrical fixture having a plug of the disclosure.

FIG. 48 is a perspective view of a fan/light assembly including a sensor board, sensors, a plug, a release rod, and a lamp lens cooperative with the sensors.

DETAILED DESCRIPTION OF THE DISCLOSURE

Figure 2:
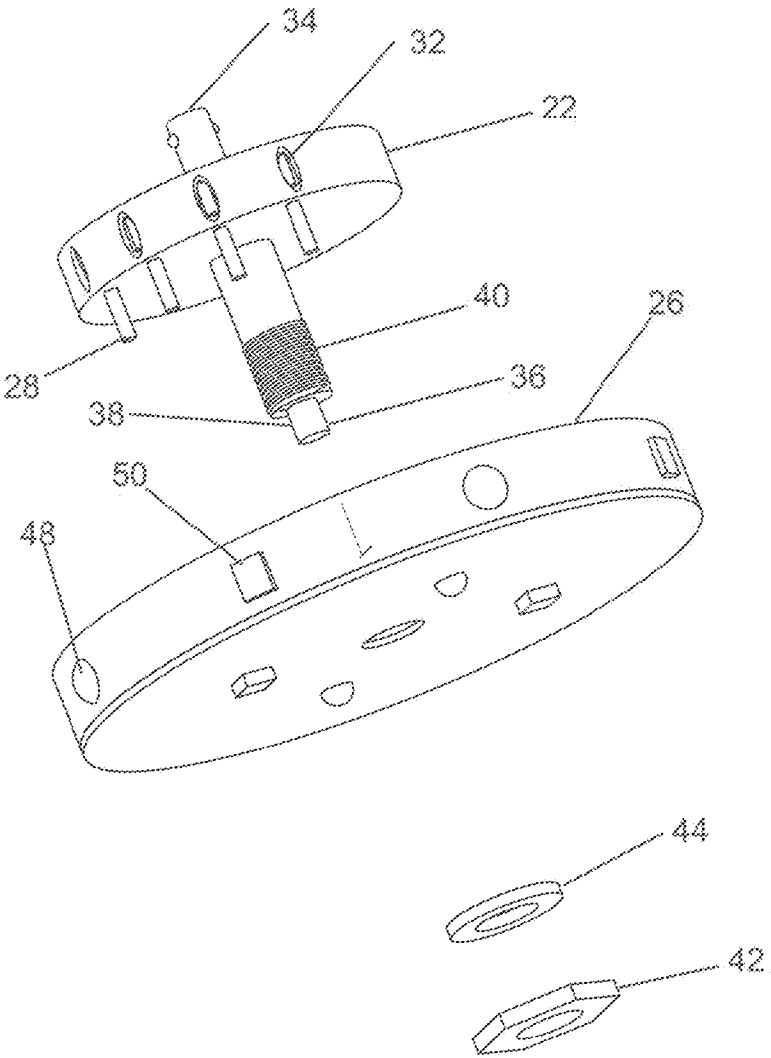
FIG. 2 is an exploded perspective view of a plug and sensing unit for a smart quick connect device according to the disclosure.
Figure 1:
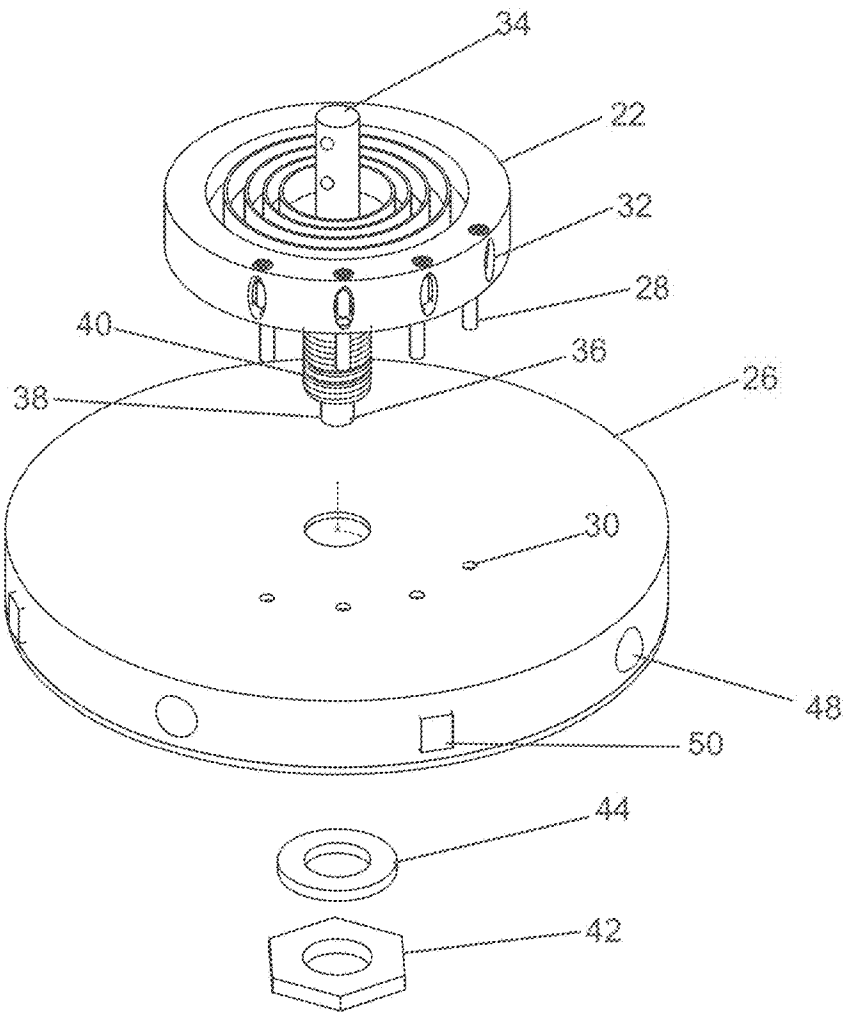
FIG. 1 is an exploded view of a plug and sensing unit for a smart quick connect device according to the disclosure.
Figure 4:
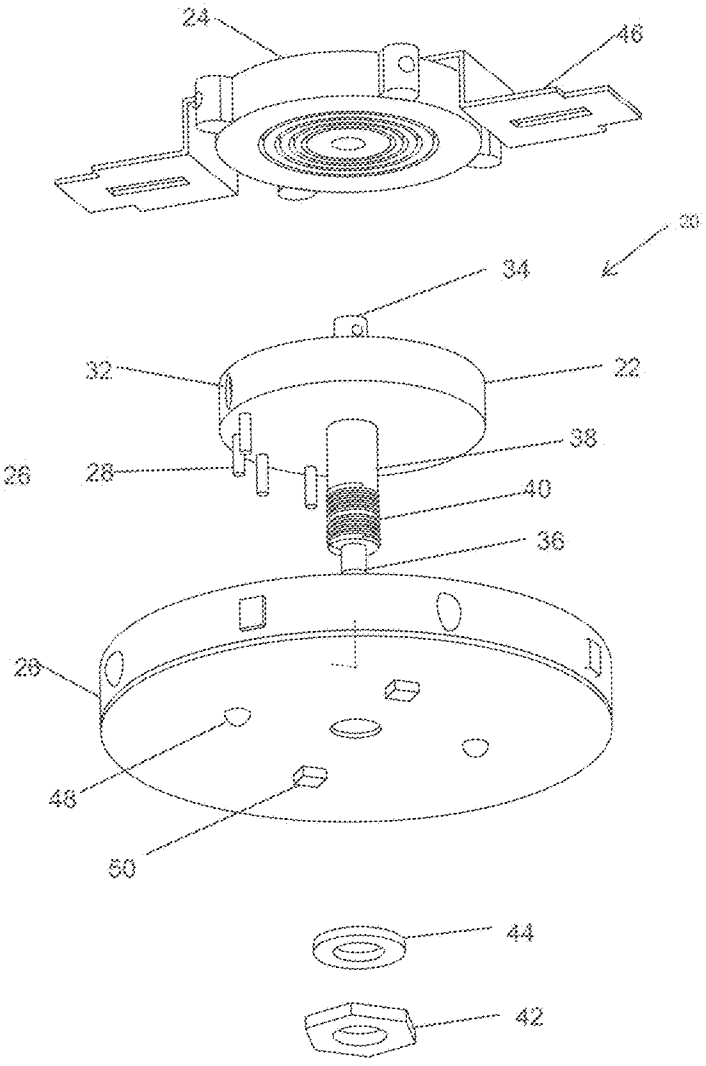
FIG. 4 is an exploded perspective view of a smart quick connect device according to the disclosure.
Figure 3:
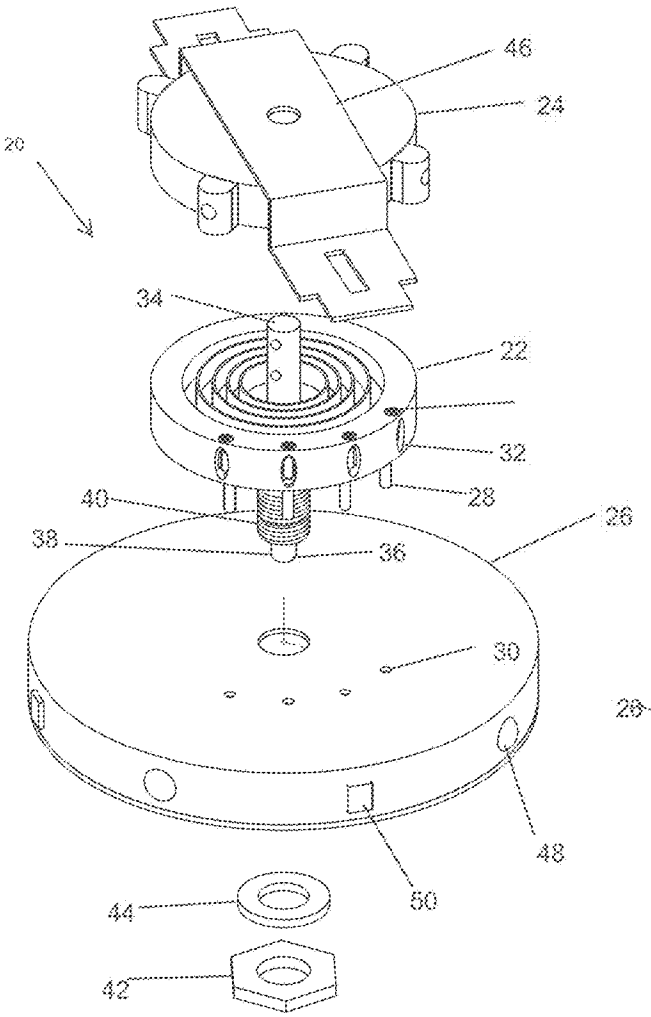
FIG. 3 is an exploded view of a smart quick connect device according to the disclosure.
Figure 5:
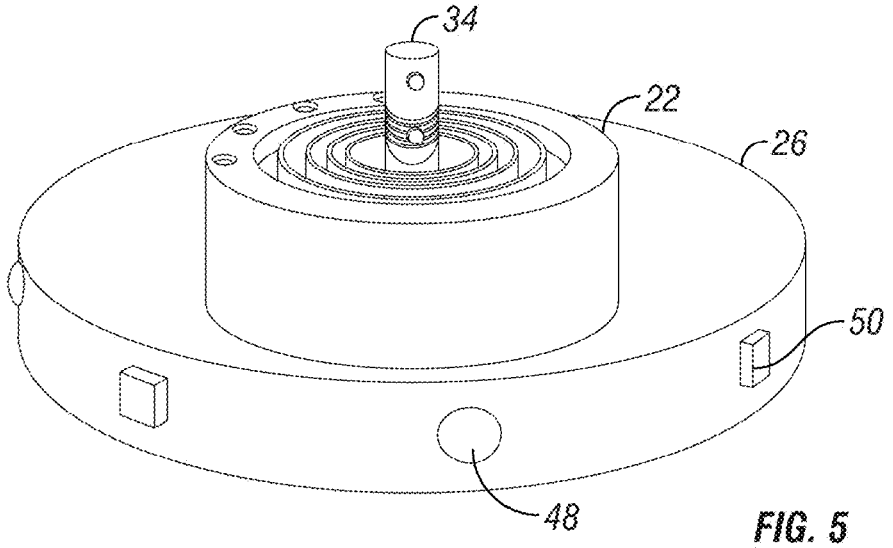
FIG. 5 is perspective view of a plug and sensing unit for a smart quick connect device according to the disclosure.
Figure 6:
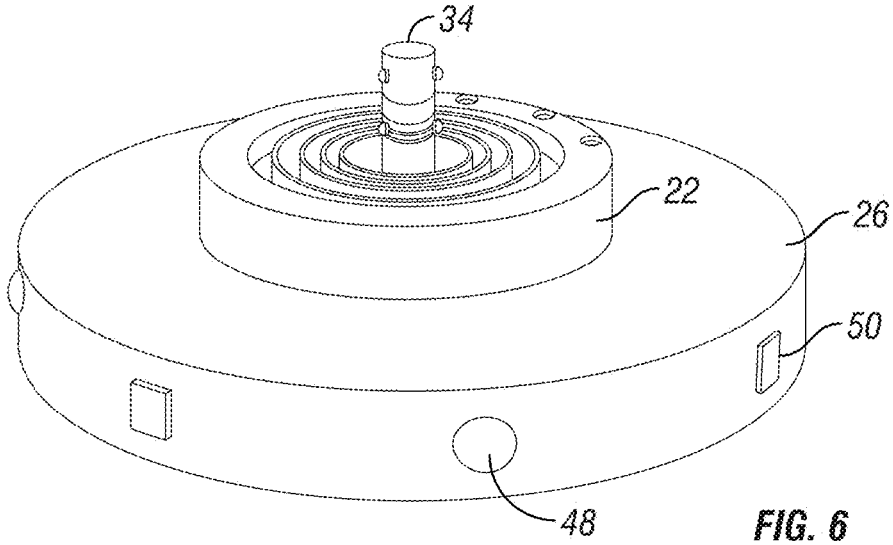
FIG. 6 is perspective view of a plug and sensing unit for a smart quick connect device according to the disclosure.
Figure 7:
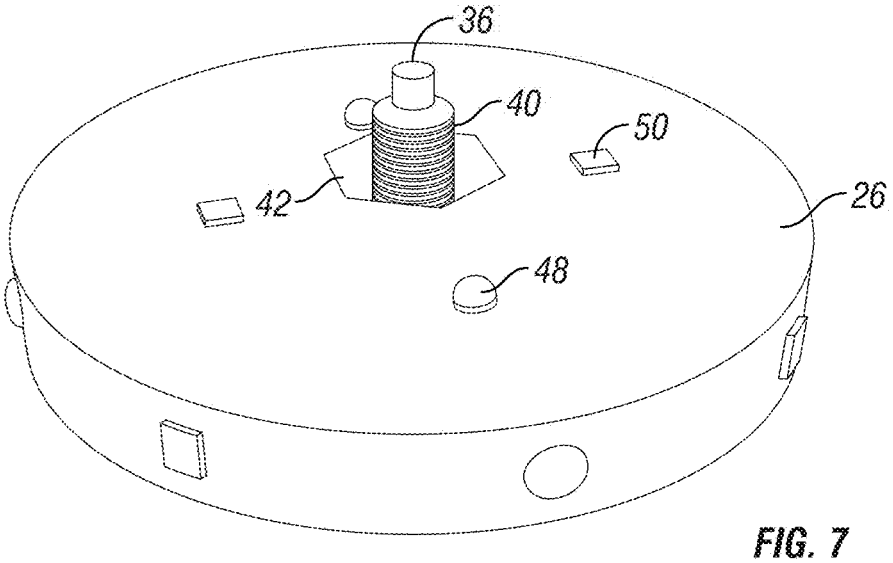
FIG. 7 is a bottom perspective view of the plug and sensing unit of FIG. 6.
Figure 8:
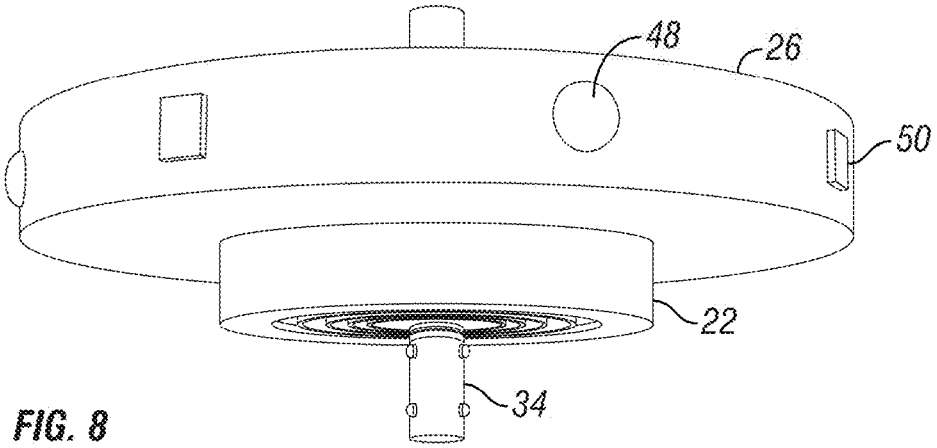
FIG. 8 is a side view of the plug and sensing unit of FIG. 6.
Figure 9:
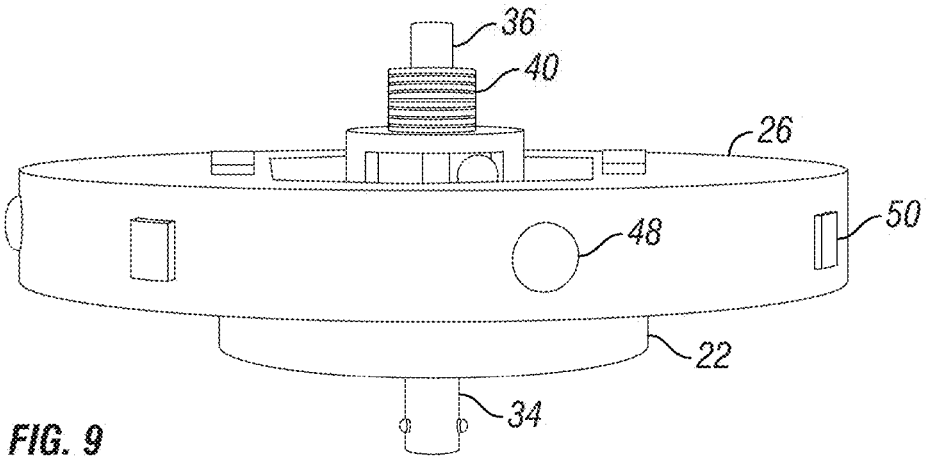
FIG. 9 is a side view of the plug and sensing unit of FIG. 6 with the plug and sensing unit upside down.
Figure 10:
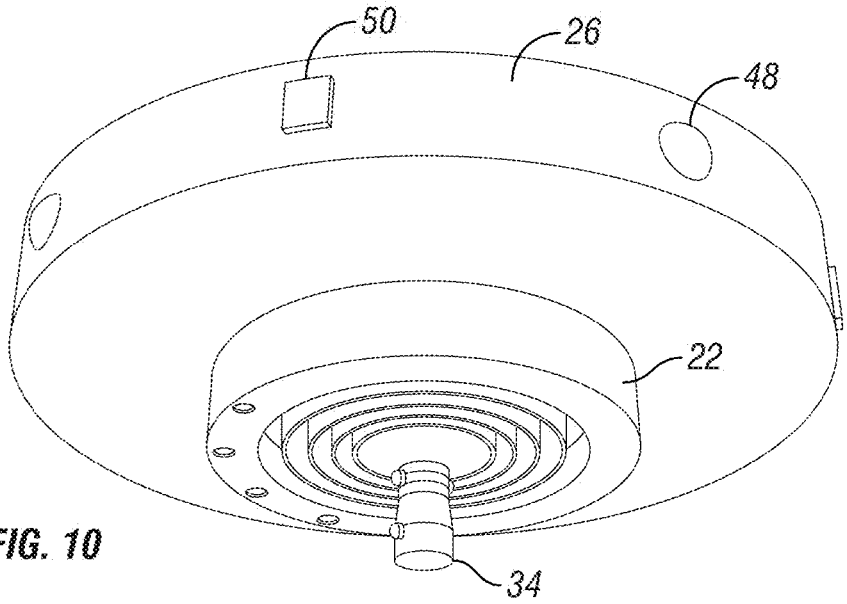
FIG. 10 is a perspective view of the plug and sensing unit of FIG. 6 with the plug and sensing unit upside down.
Figure 11:
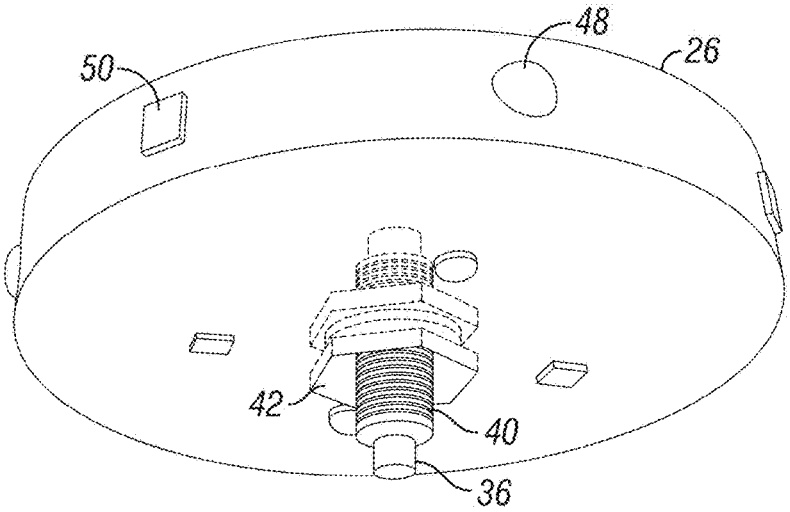
FIG. 11 is a bottom perspective view of the plug and sensing unit of FIG. 6.
Figure 12:
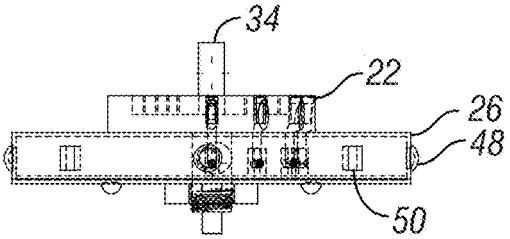
FIG. 12 is schematic view of the plug and sensing unit of FIG. 6 showing the electronic circuitry.
Figure 12:
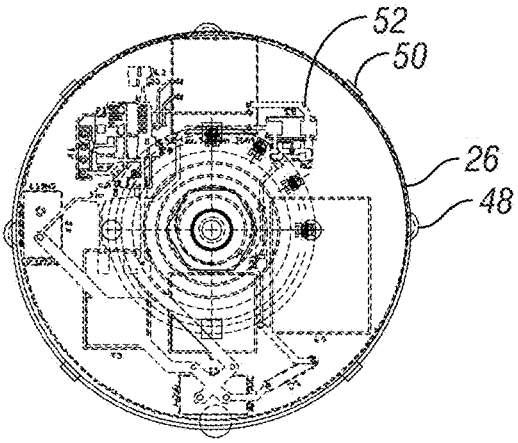

As required, embodiments are disclosed herein; however, it is to be understood that the disclosed embodiments are merely examples and that the systems and methods described below can be embodied in various forms. Therefore, specific structural and functional details disclosed herein are not to be interpreted as limiting, but merely as a basis for the claims and as a representative basis for teaching one skilled in the art to variously employ the present subject matter in virtually any appropriately detailed structure and function. Further, the terms and phrases used herein are not intended to be limiting, but rather, to provide an understandable description of the concepts.

The terms "a" or "an", as used herein, are defined as one or more than one. The term plurality, as used herein, is defined as two or more than two. The term another, as used herein, is defined as at least a second or more. The terms "including" and "having," as used herein, are defined as comprising (i.e., open language). The term "coupled," as used herein, is defined as "connected," although not necessarily directly, and not necessarily mechanically.

The disclosure herein relates to the inventor's prior work, such as that set forth above in the documents identified in the Related Patents and Applications section, the contents of each of which are herein incorporated in their entirety by reference.

A "smart quick connect device" is generally defined as a connector with additional functionality in addition to the traditional capability of providing a connection. A smart quick connect device may include a sensing unit for wirelessly communicating a sensed condition. Alternatively or in addition, a smart quick connect device can include a sensing unit for wirelessly receiving a signal. The signal can be a command signal to control the smart quick connect device and/or the associated electrical fixture. The command signal can be independent of or as a result of the sensed condition.

Referring generally to FIGS. 1-12, a quick connect device 20 for installing electrical fixtures comprises the combination of a plug 22 and mating socket 24 with a sensing unit 26. The plug 22 and mating socket 24 of the device 20 function to both establish an electrical connection between an electrical fixture and electrical supply wiring, and mechanically support the fixture on a surface or base, typically a wall, ceiling or floor surface. As used herein, the term "fixture" or "electrical fixture" means any fixture or appliance such as a lighting fixture, ceiling fan, television camera, security device or any other device which is powered by electricity supplied by electrical wiring, and which requires a mechanical connection to support or suspend the fixture. Plug 22 is fixedly secured to an electrical fixture (not shown), while the socket 24 is secured to either the surface (e.g., wall, ceiling or floor) on which the fixture is to be mounted, or to an electrical junction box.

The structure, function, and operation of plug 22 and mating socket 24 have already been detailed in, for example, the patents and application incorporated by reference herein. Accordingly, this disclosure will focus on the structure, function, and operation of sensing unit 26.

Figure 49:
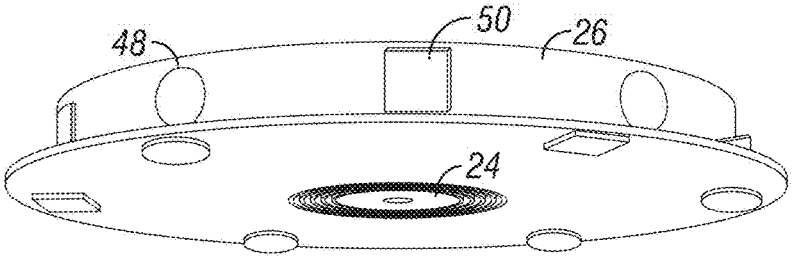
FIG. 49 is a perspective view of a socket and sensing unit for a smart quick connect device according to the disclosure.

Although sensing unit 26 is shown connected to plug 22, sensing unit 26 could be connected to socket 24 as shown in FIG. 49. It is believed, however, preferable to connect sensing unit 26 to plug 22 since different sensing unit 26 with different functionality and features could be interchangeably attached to the same plug 22. This would allow not only the fixture to be changed, but also the sensing unit 26 could be changed.

Plug 22, which receives electricity from socket 24, is electrically coupled to sensing unit 26 via pins 28, which insert into receptacles 30. Each of the receptacles can be provided with a channel 32 for establishing electrical connection with the fixture. Alternatively, sensing unit 26 can be provided with means for establishing an electrical connection with the fixture.

Plug 22 has a spindle assembly 34 for releasably mechanically connecting plug 22 to socket 24. A push button 36, which extends from the lower end of a barrel 38, provides a means of actuating spindle assembly 34 using either a finger or a tool. The lower end of barrel 38 is threaded 40 so as to receive a nut 42 (and optionally a locking washer 44). Threading 40 with nut 42 secures sensing unit 26 to plug 22. Spindle assembly 34 can also be used to mount a fixture to the plug 22. The electrical fixture may be secured to the plug 22 in any of a variety of ways. For example, the fixture may be fixedly attached by or to a guard cover, or directly to the lower threaded section of barrel 38. Alternatively, the fixture may be secured to a piece of mounting hardware, such as a "hickey" threaded onto the lower end of barrel 38. In any event, it may be appreciated that the weight of the fixture is transmitted through barrel 38 to spindle 34, socket 24, and then to a mounting strap 46, which in turn is secured to socket 24. As is well known, mounting strap 46 can be fixed to a junction box, wall or other structure on which the fixture is to be mounted.

Sensing unit 26 is provided with one or more sensors 48, 50. Sensors 48 are receiver sensors, for receiving a signal. Non-limiting examples of the signals that can be received are set forth below. Sensors 50 are transmitter sensors, for transmitting a signal. Non-limiting examples of the signals that can be transmitted are also set forth below. Sensors 48, 50 can be mounted on any surface of sensing unit 26, depending on the application.

Depending on sensors 48, 50, sensing unit 26 can allow operation of device 20 with a hand held remote using, for example, RF, Wi-Fi, or Bluetooth. Again, depending on sensors 48, 50, environmental conditions such as a temperature sensor, a humidity sensor, smoke and CO sensors, and/or motion/presence detection can be determined. In this regard, sensing unit 26 can be used as part of a security system, with sensors 48, 50 being a security camera (with or without motion activation), glass breakage detector, motion/presence detector, and/or emergency lighting (with battery backup).

Several different circuit boards for sensing unit 26 were developed that are intended to attach to and integrate with the smart quick connect device 20 and each one has varying amounts of circuitry and function depending upon the intended usage. Exemplary circuits and concepts are now described in general without a distinction of which board exactly contains which function.

Figure 13:
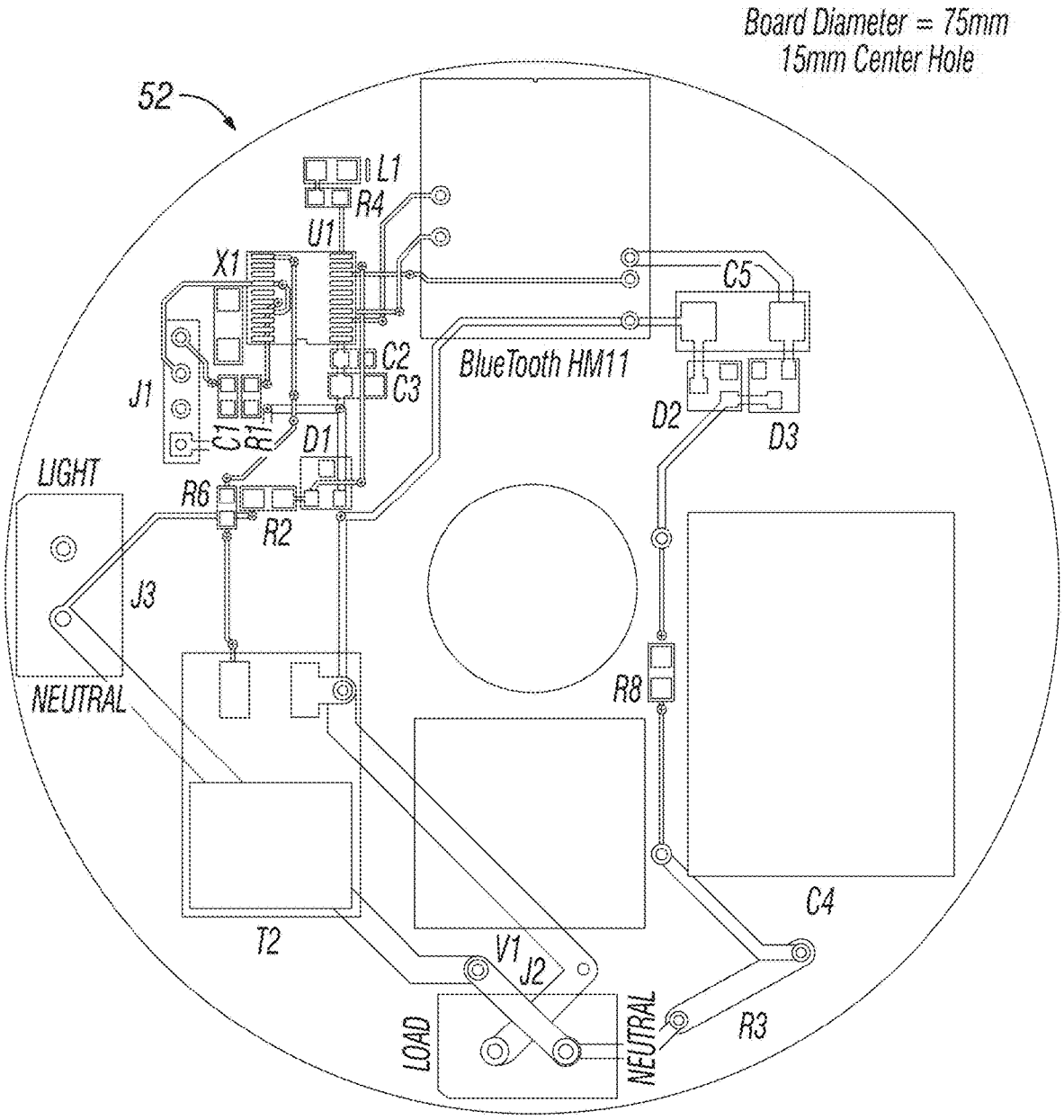
FIG. 13 is a schematic of one embodiment of the electronic circuits of a sensing unit.
Figure 14:
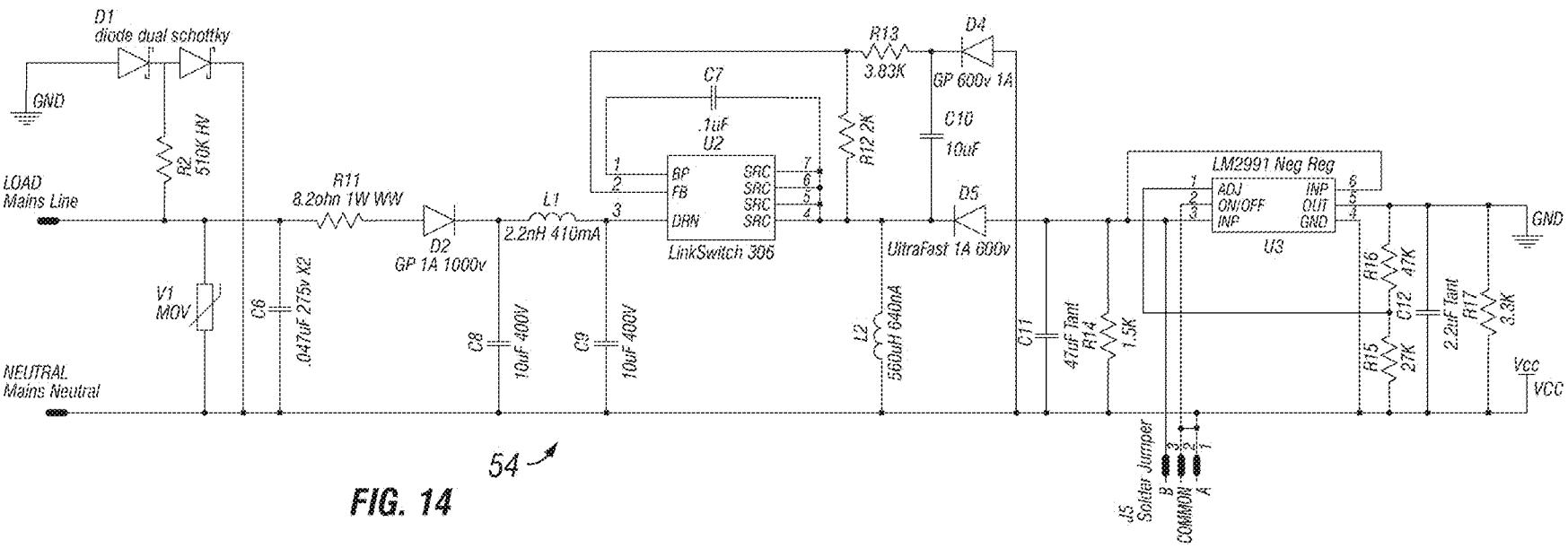
FIG. 14 is a schematic of one embodiment of a low voltage power generation circuit of a sensing unit.

In general, and as shown in FIG. 13, a sensing unit board 52 of the disclosure can be divided into the three different circuits described below, or any number of integrated or discrete circuits:

1) Low Voltage Power Generation Circuit (Element 54 of FIG. 14)

The purpose of this circuit is to derive a low voltage (for example, 3 to 3.6 v) from the high voltage AC lines. This low voltage is used to power the control circuit described below. Although the disclosure contemplates that any manner in which low voltage is obtained from high voltage AC lines can be used, two different exemplary approaches to generate the low voltage supply are now described. The first uses a mains rated capacitor, a Zener diode and other related components to provide the low voltage supply. Although this approach is simple and can be inefficient, supplying only limited current, it can be sufficient for certain applications. The second approach is a switched mode power supply (SMPS). The SMPS is more complicated, requiring more components but it is more efficient and allows higher levels of power usage by the control logic.

Figure 15:
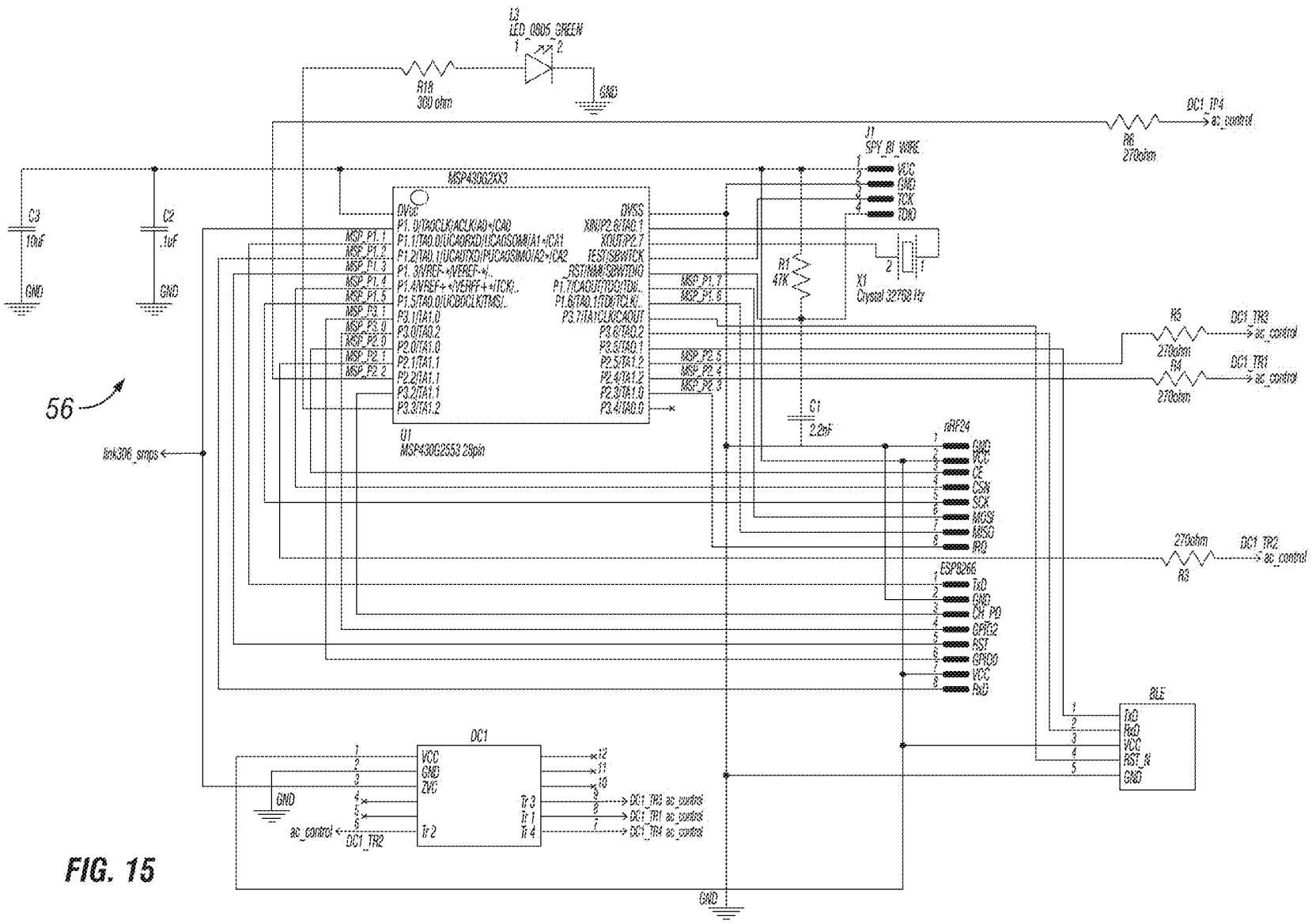
FIG. 15 is a schematic of one embodiment of a control circuit of a sensing unit.

2) Control Circuit (Element 56 of FIG. 15)

In one embodiment, the control circuit is implemented using a TI MSP430 low power micro-controller. The controller monitors input from various input sources and can then use that information to take actions related to controllable outputs.

A partial list of input sources includes, but is not limited to, the following:

a. Zero voltage crossing—used to determine when to trigger TRIACs/IGBTs to control power delivered to attached loads b. Communications (WiFi, Bluetooth, nRF24)—used to wirelessly receive incoming commands from remote control of output devices c. microphone—used for room occupancy detection d. motion detection—used for room occupancy detection e. temperature and humidity sensors—used to make heating/cooling changes f. smoke and CO detectors—used to take emergency/warning actions g. glass breakage detectors—used to control security devices A partial list of output targets includes, but is not limited to, the following. These outputs can be activated based upon connected input sources, or by remote commands received from the communications module.

A. Triacs/IGBTs . . . used to control fan and lights

B. Communications (WiFi, Bluetooth, nRF24) . . . used to transmit status or convey emergency situations C. Security camera: used to capture images when triggered by various input sources D. Emergency backup light: used to provide minimal lighting in emergency situations.

Figure 16:
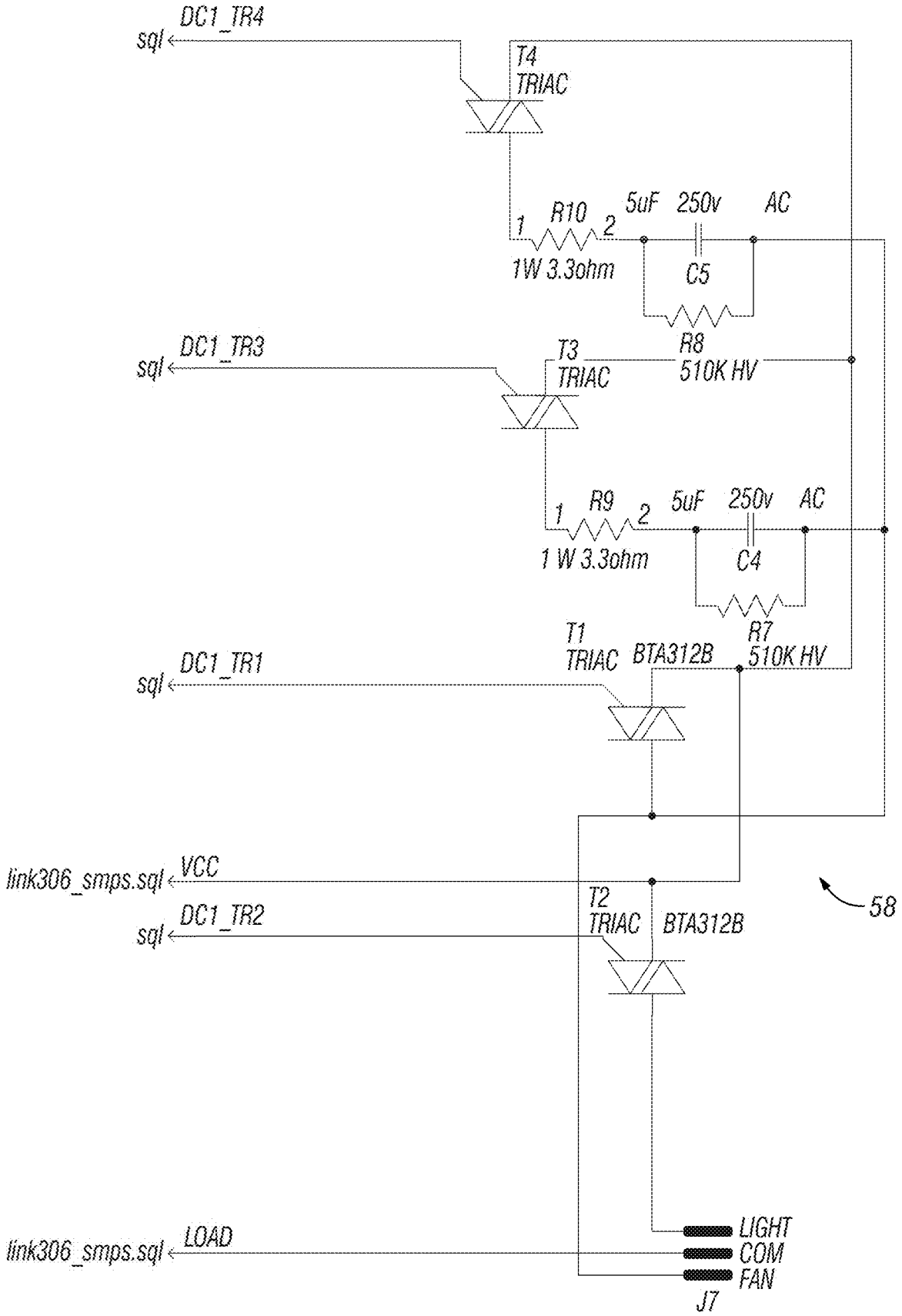
FIG. 16 is a schematic of one embodiment of a high voltage AC control circuit of a sensing unit
Figure 17:
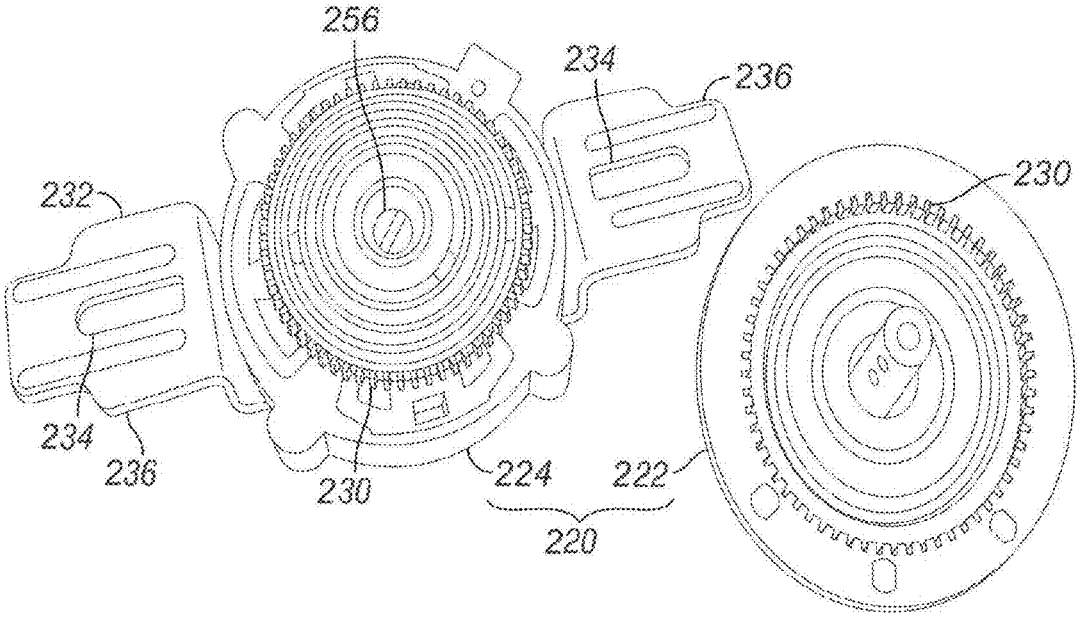
FIG. 17 is a view of an embodiment of a plug and socket (receptacle) of a quick connect device according to the disclosure.

3) High Voltage AC Control Circuit (Element 58 of FIG. 16)

The circuit which actually throttles the AC power destined for the load (for example, a light, a fan, or a combination light and fan fixture) under the control of the control and communications circuit described above are either TRIACs or IGBTs. These devices are switched on/off at different times during the AC cycle to control how much power is actually passed to the load and determine fan speeds (low to high) and light level (dim to bright).

As best seen in FIGS. 17, 25, 29, and 31-34, a quick connect device 220 for installing electrical fixtures comprises the combination of a plug 222 and mating socket 224. The present disclosure contemplates that device 220 can be used with or without sensing unit 26, which can be located on plug 222 and/or socket 224. The device 220 functions to both establish an electrical connection between an electrical fixture and electrical supply wiring, and mechanically support the fixture on a surface or base, typically a wall, ceiling or floor surface. As used herein, the term "fixture" or "electrical fixture" means any fixture or appliance such as a lighting fixture, ceiling fan, television camera, security device or any other device which is powered by electricity supplied by electrical wiring, and which requires a mechanical connection to support or suspend the fixture. Plug 222 is fixedly secured to an electrical fixture 226, while the socket 224 is secured to either the surface (e.g., wall, ceiling or floor) on which the fixture is to be mounted, or to an electrical junction box 228.

Unless otherwise shown or described herein, the structure, function, and operation of plug 222 and mating socket 224 have already been detailed in, for example, the patents and application incorporated by reference herein, and elsewhere herein. Accordingly, this disclosure will focus on the improvements in structure, function, and operation of plug 222 and mating socket 224 as well as other related improvements.

Figure 32:
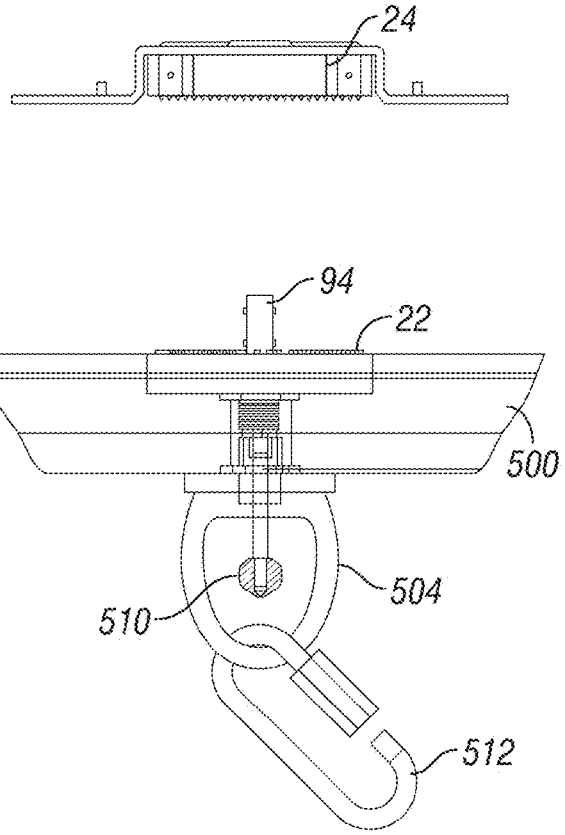
FIG. 32 is a side view of a combination including a plug, a latching mechanism, a canopy, and a supporting extension.
Figure 33:
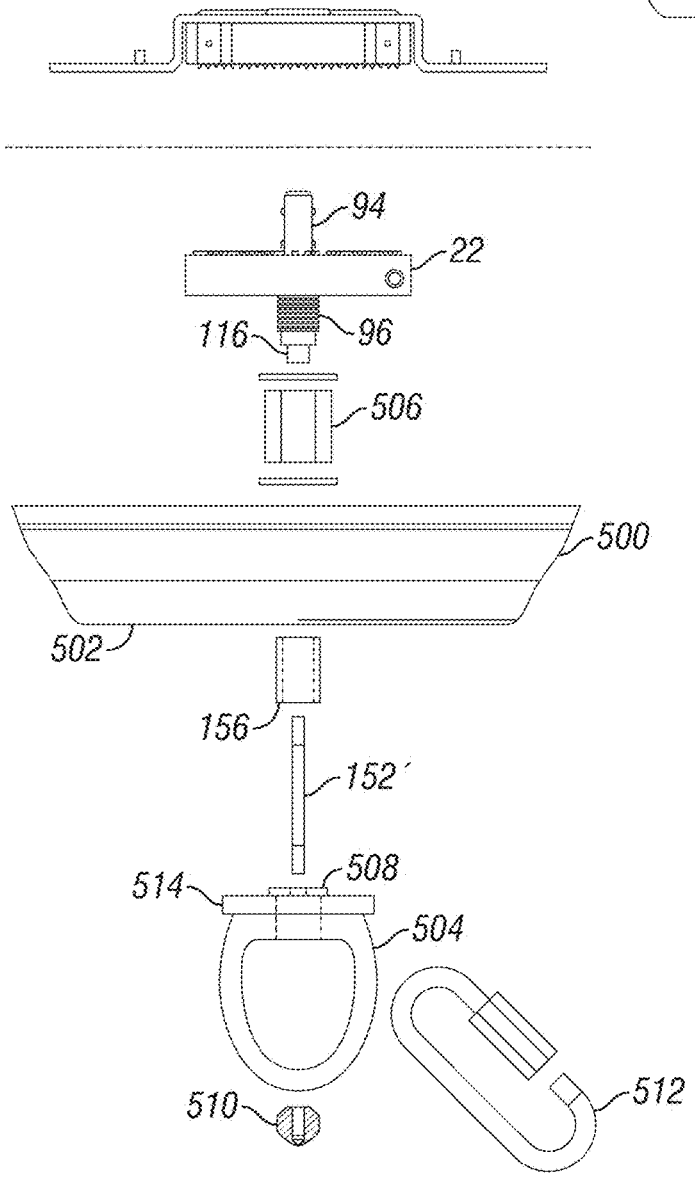
FIG. 33 is an exploded side view of the combination of FIG. 16.
Figure 34:
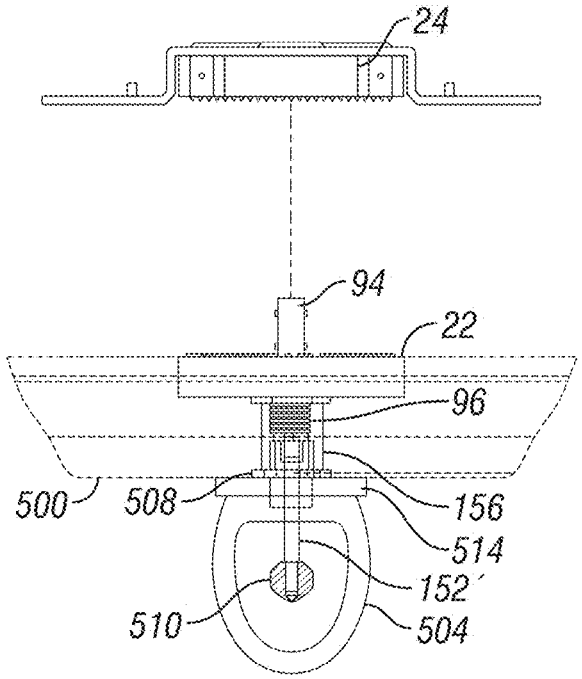
FIG. 34 is a medial cross section of the combination of FIG. 16.

One such improvement is the location of teeth 230 on plug 222 and socket 224. In the related patents and application, these teeth are located on the opposing faces of plug 222 and socket 224. This arrangement of teeth 230 is shown in FIGS. 32-34 for comparison purposes. In contrast and as shown in the remaining FIGS., teeth 230 can alternatively be located on the peripheral surfaces of the opposing faces of plug 222 and socket 224. This has been found to minimize the effects of temperature, humidity, and other environmental conditions in the mating of teeth 230 to rotationally fix plug 222 with respect to socket 224. In a non-limiting example, each of teeth 230 may be approximately 1 mm in height and approximately 2 mm in width.

Irrespective of the location of teeth 230, the plurality of circumferentially spaced, radial extending indexing teeth 230, preferably integrally molded into socket 224 and plug 222, inter-engage or mesh when plug 222 and socket 224 are mated to prevent plug 222 and socket 224 from rotating relative to each other. Prior to teeth 230 engaging, plug 222 and socket 224 are free to rotate relative to each other. With the dual position locking mechanism of plug 222 and socket 224 described later and akin to that disclosed in related application U.S. Patent Application Publication No. 20090280673, in the initial locking position, plug 222 is held a distance away from socket 224 so that relative rotation between plug 222 and socket 224 is possible while plug (with or without the fixture attached to plug 222) is held the distance away. In the second locking position, teeth 230 of plug 222 engage teeth 230 of socket 224 to prevent axial and rotational movement of plug 222 with respect to socket 224. The circumferential arrangement of the teeth enables positioning of an attached plug and associated device at as many radial orientations as there are teeth, throughout a 360 degree range. Socket 24/224 and mating plug 22/222 can be formed with a body or casing that is fire retardant.

By positioning teeth 230 aligned axially and alongside surfaces of socket 224 and plug 222, a contact surface between socket 224 and plug 222 can be increased by lengthening teeth 230 on each of socket 224 and plug 222. This additionally helps ensure continued engagement if socket 224 and plug 222 expand or contract, due to temperature, to differing extents. For example, the length of teeth 230 can be determined based upon a maximal difference in relative sizes of socket 224 and plug 222 along the axial direction of the plug and socket. Further, increasing overlap for axially aligned teeth does not result in a change in tooth pitch, whereas increasing overlap radially requires increasing the diameter, or having areas of reduced pitch, which can be more easily affected by an expansion differential between socket 24 and plug 22.

Figure 18:
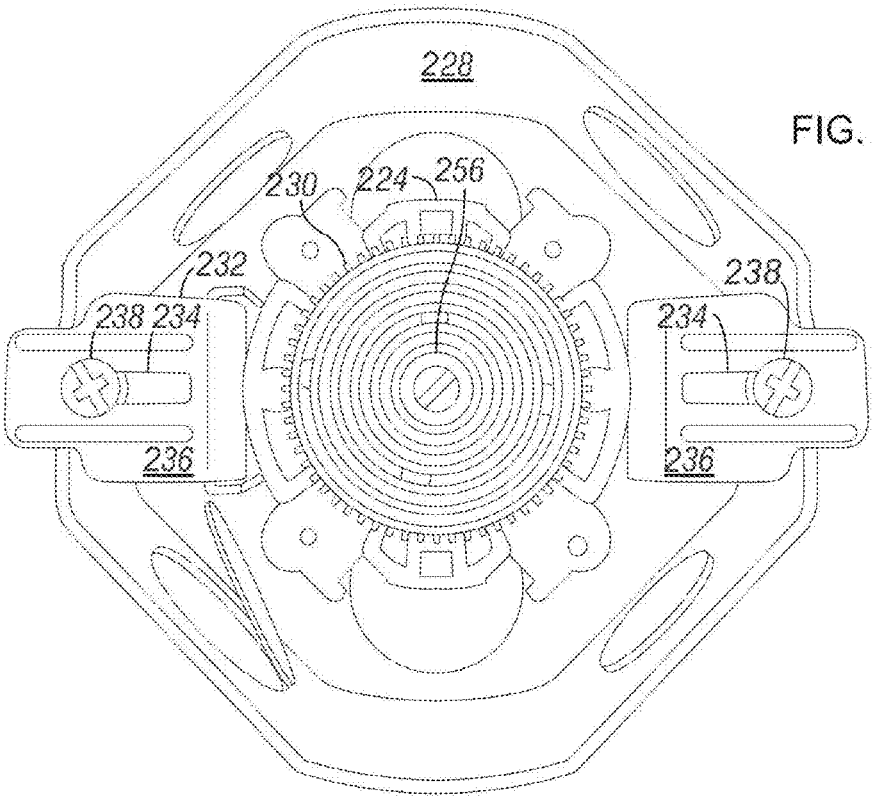
FIG. 18 is a view of the socket of a quick connect device according to the disclosure installed in a standard electric junction box.

FIG. 18 shows socket 224 installed in a standard electrical junction box 228. In this embodiment, mounting strap 232 is generally U-shaped and is provided with an aperture 234 on each of its outer extremities or flanges 236 which receives a screw 238 to mount the strap 232, and thus the entire device 220, on a suitable mounting surface. In the illustrated embodiment, the spacing between the apertures 234 is selected so that the strap 232 can be affixed to a common electrical junction box 228 formed of metal or plastic and having threaded holes or nuts into which the screws 238 may be driven. The U-shaped configuration of the strap 232 allows the socket 224 to be recessed within the junction box, as illustrated in FIG. 18. However, in those applications where it is necessary to mount the socket 224 directly on a wall or ceiling without use of a junction box, a flat strap may be employed. Socket 24 can be secured to the strap 232 by means of screws. However, other techniques may be used to secure the socket 224 to the strap 232.

FIGS. 19-21 depict a face plate 240 that can be used to cover the space in electrical junction box 228 that socket 224 does not cover. Face plate 240 can provide a more aesthetically pleasing appearance and eliminates access to exposed energized parts that are not otherwise protected by socket 224. This can be particularly useful in situations, which is often the case, in which there will be some time in between installation of socket 224 and plug 222 (with a fixture attached). Although face plate 240 is shown as generally circular, any suitable shape could be used. The edge of face plate 240 can be provided with a rim 242 so that rim 242 is substantially flush with the mounting surface. Face plate 240 is provided with an opening 242 to accommodate socket 224. To accommodate mounting strap 232, face plate 240 has a cut out 244 as shown in FIG. 20 into which flanges 236 recess. Resilient tabs 248 deflect outward and deflect back in to hold face plate 240 to mounting strap 232. The present disclosure contemplates that means other than resilient tabs 248 can be utilized to releasably hold face plate 240 to mounting strap 232.

Figure 23:
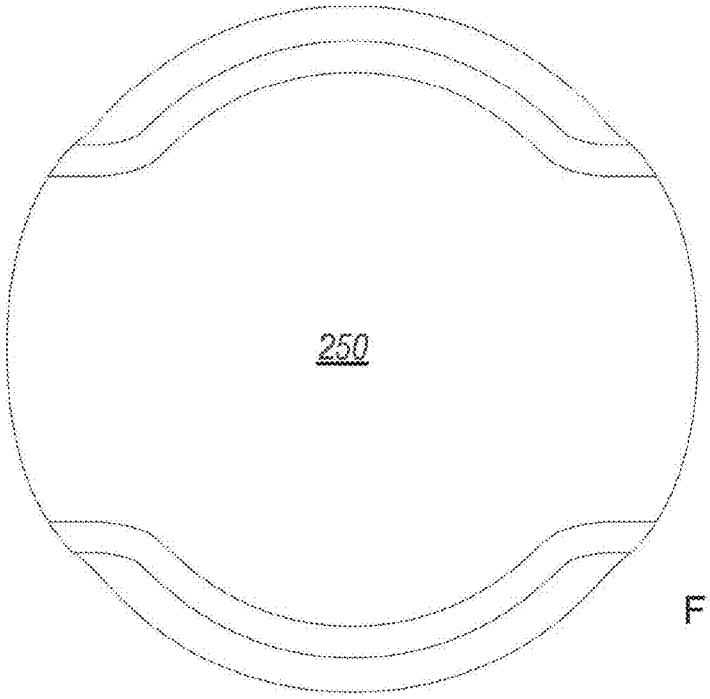
FIG. 23 is a front view of the face plate centerpiece of FIG. 6.
Figure 24:
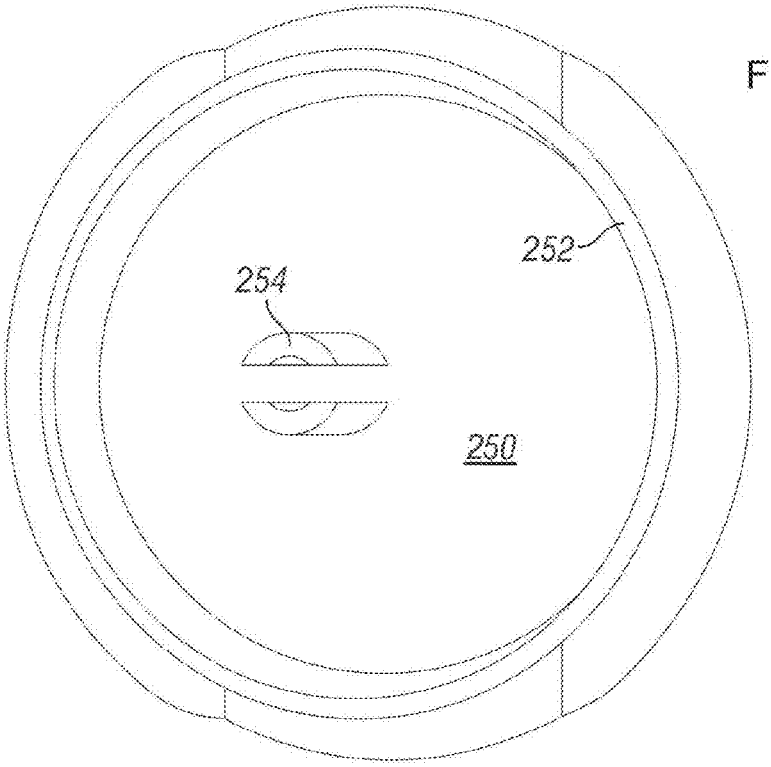
FIG. 24 is a back view of the face plate centerpiece of FIG. 7.
Figure 25:
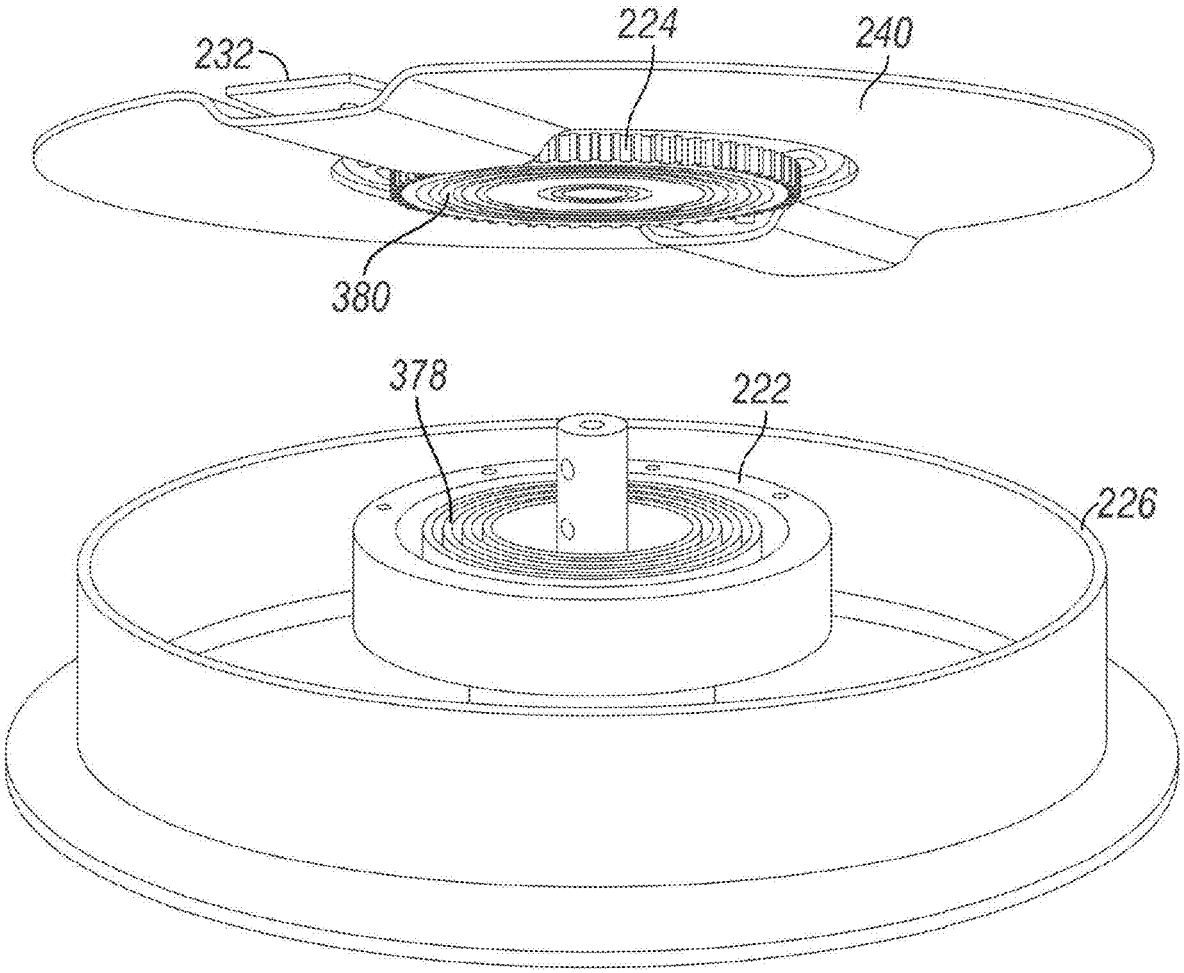
FIG. 25 is a view of an installed socket and face plate and a separate plug installed on a light fixture.
Figure 26:
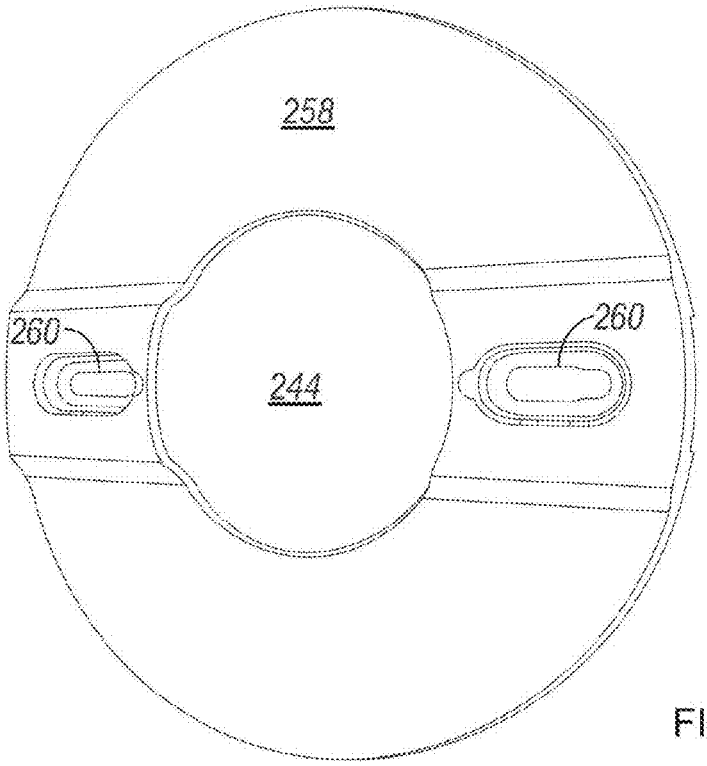
FIG. 26 is a front view of another embodiment of a face plate according to the disclosure.

At this point, the fixture can be connected to socket 224 via plug 222 for immediate use as shown in FIG. 25. As shown in FIG. 26, a face plate centerpiece 250 can be attached to socket 224 or face plate 240 to create a cover plate to protect (from painting, dust, etc.) socket 224 and for aesthetic purposes until a later time when the fixture is connected. FIGS. 23 and 24 show one embodiment of a face plate centerpiece 250. The front of centerpiece 250 can have a design to match that of face plate 240 so as to provide a continuous or near continuous appearance. The back of centerpiece 250 can be provided with an upstanding, peripheral edge 252 which is received in tight frictional engagement over the lower cylindrical portion of socket 224. This frictional engagement is sufficient to hold centerpiece 250 in place. Alternatively, or in addition to peripheral edge 252, centerpiece 250 can have a post 254 that is receiving in central bore 256 of socket 224. As shown, post 254 is in two portions so as to deflect inward upon insertion into bore 256 and deflect back outward to secure centerpiece 250 to socket 224.

Any of a wide variety of devices can be connected to socket 24/224, including any of a fixed or PTZ (pan tilt zoom) camera; fan; video projector; hanging display which can be illuminated; video display; chandelier; camera housing; smoke detector; video intercom; wall sconce with individual or multiple heads; toys and moving objects; emergency lighting; outdoor lighting; exit sign; decorative lighting; interface to smartphone, tablet, or other computing device; sensing unit as described herein, or other devices or sensors as described herein.

Figure 27:
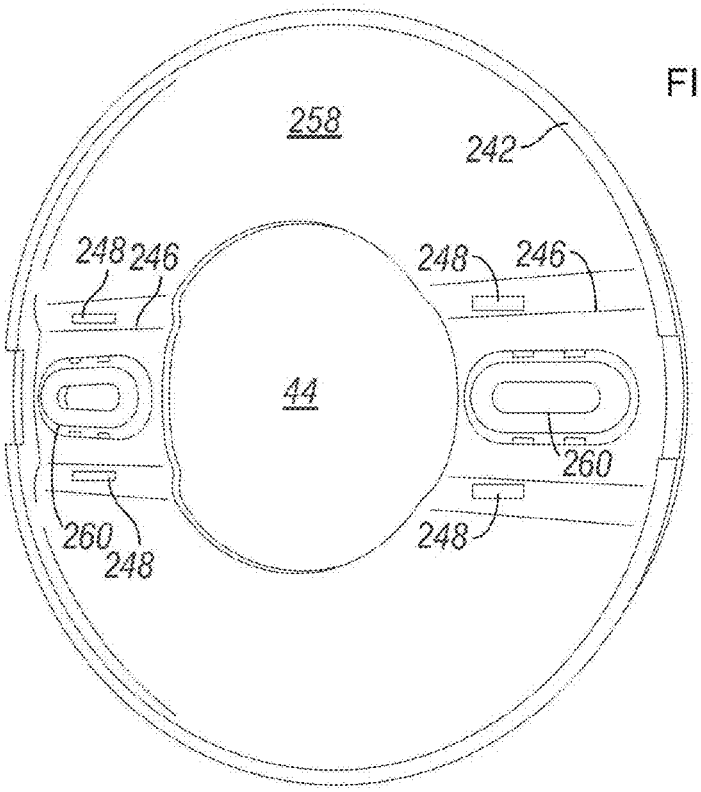
FIG. 27 is a back view of the face plate of FIG. 10.

FIGS. 26 and 27 shown another embodiment of a face plate 258 according to the disclosure. Face plate 258 is similar to face plate 240 but also has slots 60 that match screw holes 234 on mounting strap 234 so that slots 60 align with screw holes 234. As a result, screws 238 would secure both socket 224 and face plate 258 to electrical junction box 228.

Figure 28:
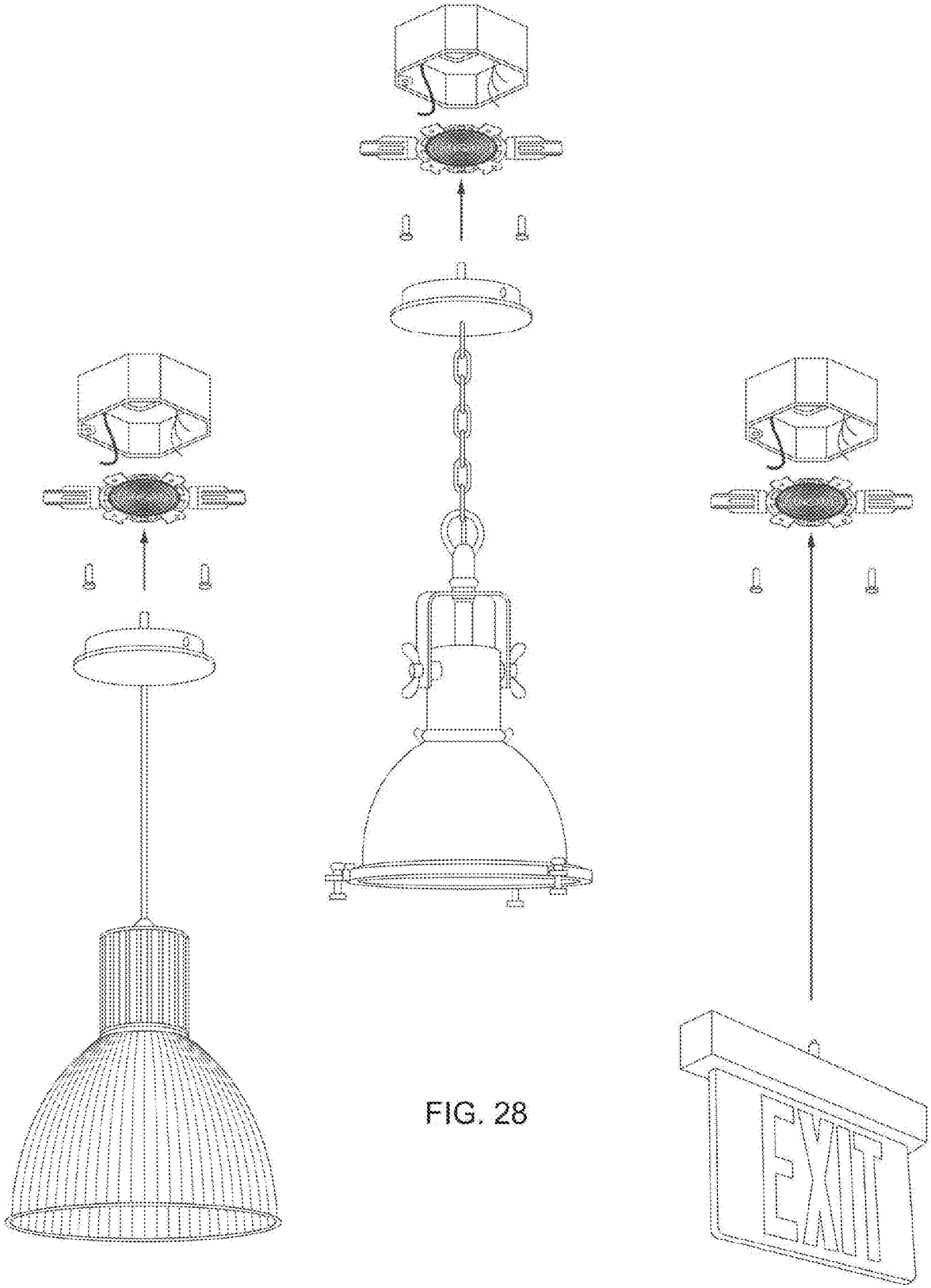
FIG. 28 shows some exemplary uses of the socket and plug according to the disclosure.

FIG. 28 schematically shows the simplified installation process of device 20, regardless of whether the fixture is a ceiling fan or light fixture. After the standard electrical junction box is installed, socket 224 is mounted onto junction box 228 via mounting strap 232 of socket 224. Optionally, face plate 240 can be installed. At this point, the fixture can be quick-connected into socket 224 via plug 222.

Device 20 allows for safer wiring, installation and removal of light fixtures and ceiling fans. Once the socket and face plate are in place, there are no longer exposed energized parts. Heavy or bulky fixture components no longer have to be supported while making wire connections to the electrical circuit. Installation, connection and maintenance of the fixture are inherently safer because heavy and bulky units do not have to be maneuvered while the socket is being installed, where the installer is typically on a ladder or lift.

Regarding the weight handling capacity, the double locking mechanism ensures the socket and plug fitting can bear the load; the double locking mechanism holds up to 200 pounds and has been tested to failure at 900 pounds. However, the load is limited by the capacity of the outlet box, which is normally 35 pounds for ceiling fans or 50 pounds for light fixtures, unless listed and labeled otherwise (e.g., indicated greater weight capacity).

Figure 29:
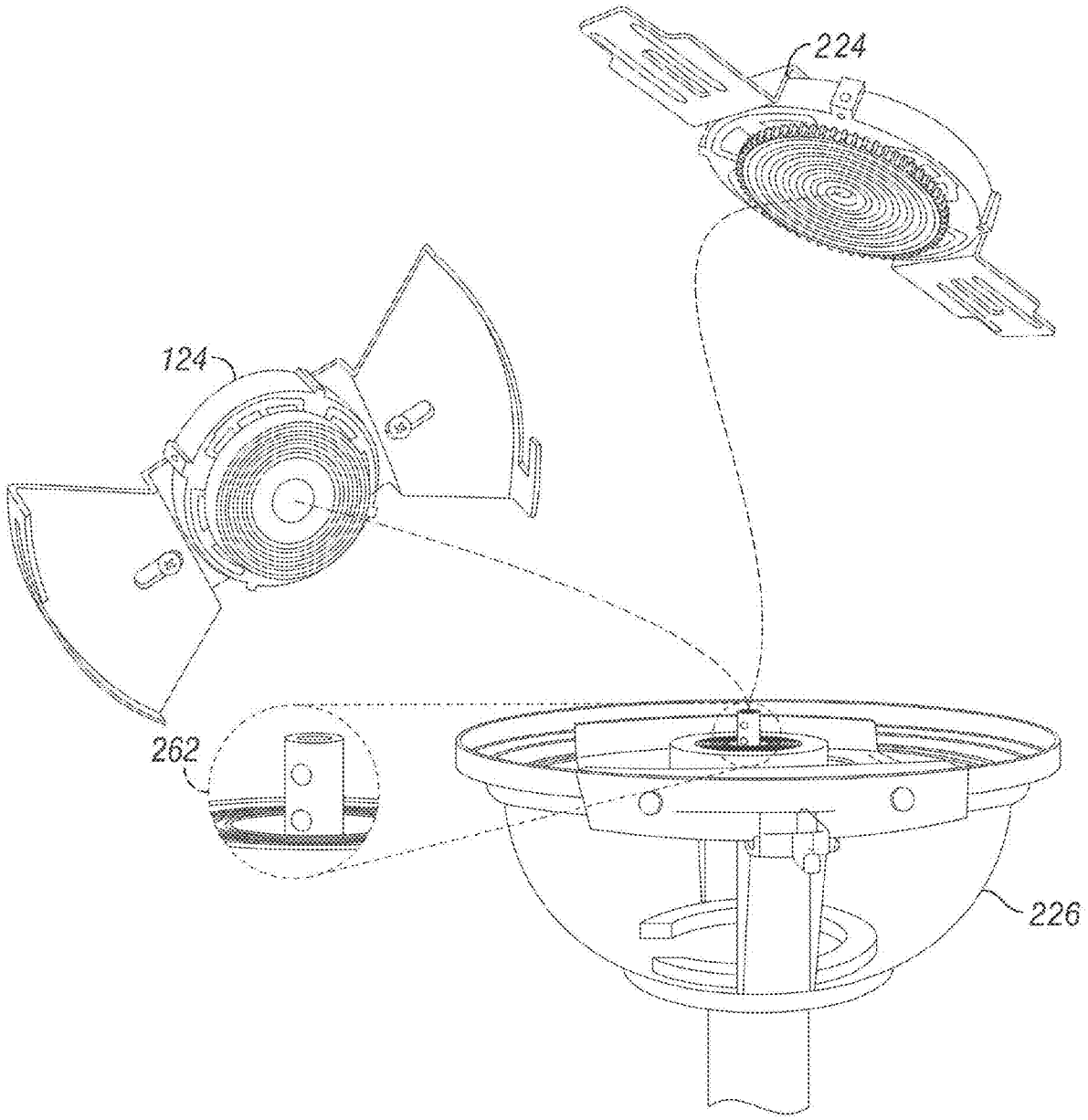
FIG. 29 shows an embodiment of the socket and plug according to the disclosure for use with a light fixture and an embodiment of the socket and plug according to the disclosure for use with a ceiling fan.

FIG. 29 shows the double locking mechanism 62. The double locking mechanism 62 can be in socket 224, which can be used for any suitable fixture, or fan socket 124, which has an additional locking feature that can be beneficial for holding the added weight of a ceiling fan.

Figure 30:
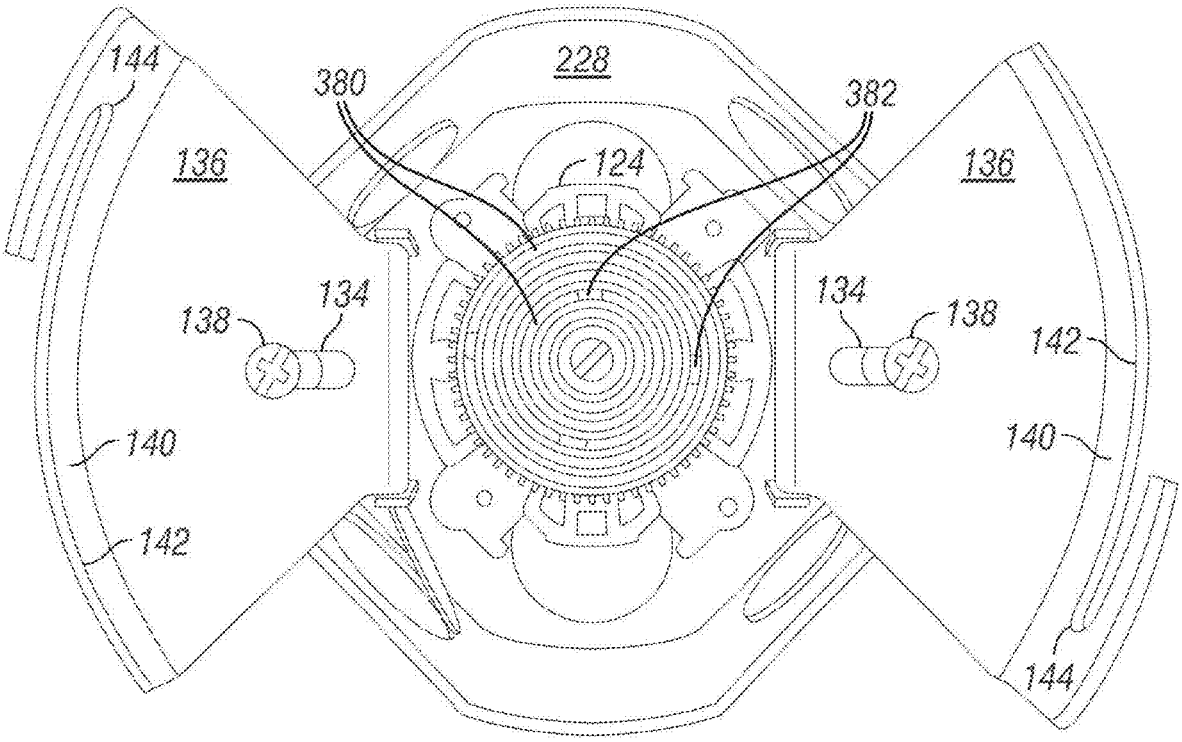
FIG. 30 is a view of a socket and plug according to the disclosure for use with a ceiling fan installed in a standard electric junction box.
Figure 31:
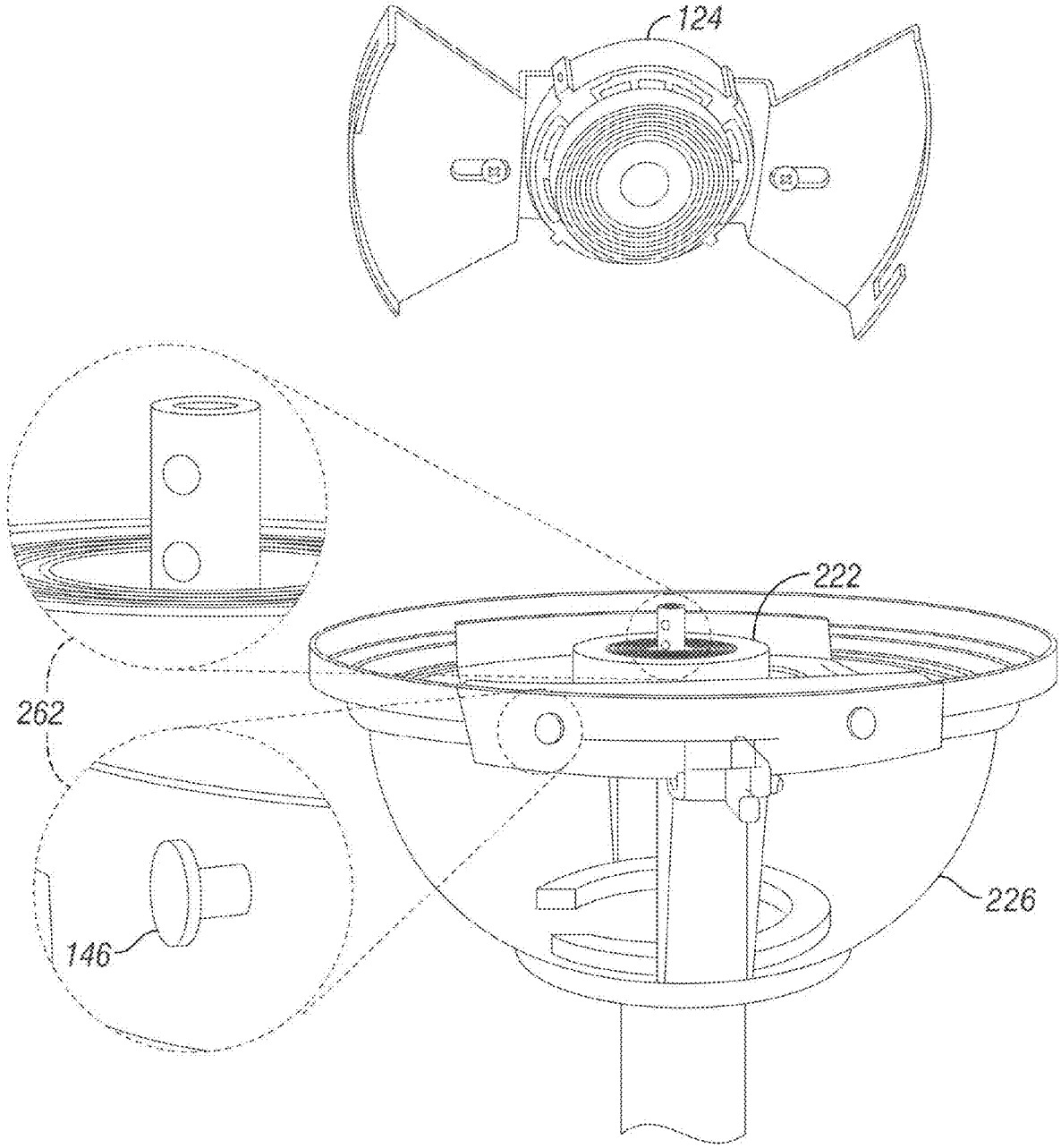
FIG. 31 schematically shows the three locking mechanism of the socket and plug for use with a ceiling fan.

As shown in FIGS. 30 and 31, fan socket 124 has a mounting strap 132 that while sharing the same general function and some features of mounting strap 232, differs from mounting strap 232. In this embodiment, mounting strap 132 is generally U-shaped and is provided with an aperture 134 on each of its outer extremities or flanges 136 which receives a screw 138 to affix the strap 132, and thus fan socket 124 to a common electrical junction box 228 formed of metal or plastic and having threaded holes or nuts into which the screws 138 may be driven. The U-shaped configuration of the strap 132 allows the fan socket 124 to be recessed within junction box 228, as illustrated in FIG. 30.

Flanges 136 of mounting strap 132 flare outward and have an arcuate outer curvature 140 that is similar to the curvature for the canopy of ceiling fans. An edge 142 extends from the outer curvature 140 and includes a track 144 for receiving a mounting bracket for the ceiling fan. The track 144/screw 146 combination provides an additional locking mechanism for increased mechanical support.

With reference to FIGS. 32-37, cover, or canopy 500, is provided for safety and aesthetic purposes, and further for the purpose of exposing means for releaseably connecting to a fixture, and particularly to a suspended non-electrical or electrical fixture. Canopy 500 has an inner face which conceals quick connect device, electrical wires, and electrical junction box, and is further provided with a centrally located aperture 502. Aperture 502 is sized at least sufficiently large to allow the passage of push rod 116. Where canopy 500 is bell shaped, or has an extended depth, as shown, an extending member, such as long push rod 152 or 152', or an elongated push rod 116 extends through aperture 502.

An open or closed supporting extension 504, extends from the outer face of canopy 500, connected to plug 222. In the embodiment shown in FIG. 33, extension 504 threadably engages guide barrel 156, which in turn threadably engages coupler 506, which in turn threadably engages spindle assembly 100. An aperture 508 is provided in extension 504 to allow the passage of push rod 116, or as shown, long push rod 152' threadably connected to push rod 116. A rod cap 510 may be provided to facilitate pushing long push rod 152' with a finger. Push rod 152' is sized so that, with cap 510 in place, it is sufficiently long to allow operation of spindle assembly 100 to disengage, as described above, when pushed upwardly.

With further reference to FIG. 33, canopy 500 is maintained in a desired position by a shoulder 514 on extension 504, sized larger than aperture 502 in canopy 500. Alternatively, with reference to FIG. 35, aperture 502 is sized sufficiently large to allow passage of extension 504, but not ring 516, the latter being threadably engaged with the base of extension 504, and operative thereby to maintain canopy 500 in position.

It should be understood that extension 504 may be connected to the lower threaded portion 96 of barrel 94 by a variety of means. For example, extension 504 may be formed integrally with canopy 500, or may be connected to canopy 500 by welding, adhesion, or other known method, and canopy 500 thence connected to plug 222 by a coupling attached thereto (not shown), threaded to spindle assembly 100. Alternatively, extension 504 may be advantageously used without canopy 500, where the latter is neither needed nor desired. Extension 504 is connected to spindle assembly 100 as described above, however canopy 500 is not present.

Figure 37:
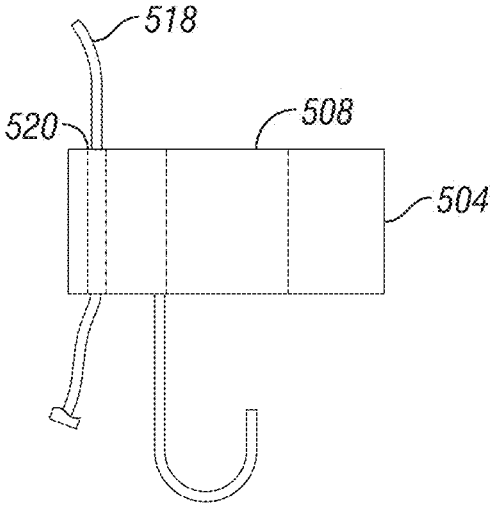
FIG. 37 is a series of alternative embodiments of supporting extensions.

It should be further understood that extension 504 may be effectively formed in a variety of open or closed shapes, including the embodiments 504*a* through 504*e*, as shown in FIG. 37.

Where an electrical fixture is provided with a hook operative to suspend same, the fixture may be directly connected to extension 504. Where an electrical fixture is provided with a loop, such as a chain, to suspend same, and where extension 504 is similarly formed as a closed loop, the electrical fixture may be connected to extension 504 with the use of an interposed linking member that may be disconnected, such as quick link 512, shown in FIGS. 32 and 33, or other known means for releaseably connecting two closed loops.

Figure 35:
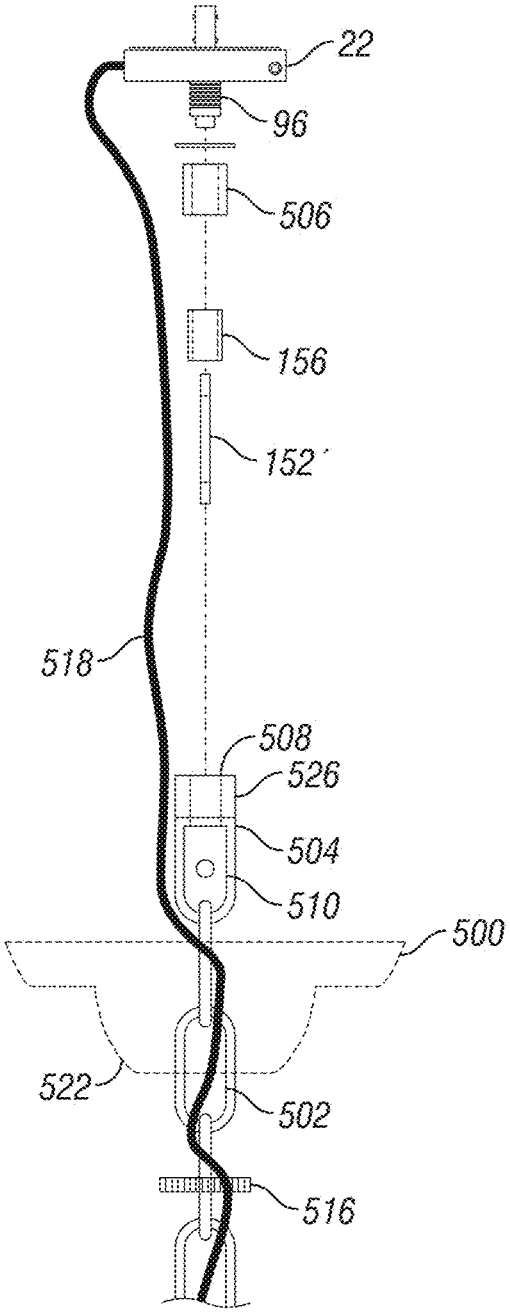
FIG. 35 is an exploded side view of a combination including a plug, a latching mechanism, and a supporting extension.
Figure 36:
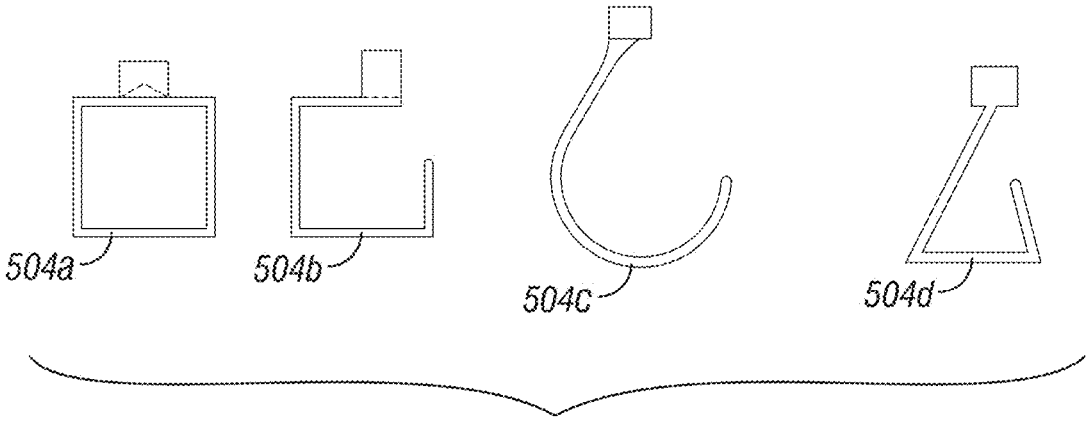
FIG. 36 is a side view of a supporting extension with a wire passage.

With reference to FIGS. 35 and 36, electrical wires 518 are connected to plug 222, and an electrical fixture, as described above, and pass therebetween through canopy 500, or through extension 504. If passing through canopy 500, wires 518 pass through a conveniently located aperture, such as 522, and if needed, a protective grommet 524 is provided at the passage. Alternatively, as can be seen in FIG. 36, wires 518 pass through extension 504 at aperture 520. It should be understood, however, that extension 504 may be advantageously used to connect fixtures not requiring an electrical connection.

It should be further understood that supporting extension 504 can be advantageously utilized with a lateral actuator assembly of the type shown and described with respect to FIG. 26, wherein aperture 508 need not be provided, and extension 504 is connected to plug 222 by other means, such as through a mechanical attachment, or through attachment to canopy 500, as described above.

Referring now to FIG. 38, device 300 includes a plug 222 which is mechanically and releasably connected to sensing unit 26, for example by threads 40, or alternatively by a press-fit connection, adhesive, clips, acoustic welding, or any other mechanical connection method.

In an embodiment, plug 222 (or plug 22) is electrically connected to sensing unit 26 using pins 28, or alternatively by contacts, one or more plug and socket connections, or by any other electrical connection type. Alternatively, sensing unit 26 can form a connection directly to a wiring system of the edifice into which a device of the disclosure is installed, without connecting to plug 222.

In an alternative embodiment, sensing unit 26 does not form a wired connection to either plug 222 or wiring of the edifice, and is battery operated and can communicate using one or more forms of wave energy transmission.

The assembly of plug 222 and sensing unit 26 is collectively contained within a housing 320 having windows 322 as required for transmission of light or other wave energy between sensing unit 26 and an exterior of housing 320. More particularly, windows 322 align with sensors 48, 50 of sensing unit 26 when sensing unit 26 is mounted within housing 320. For appearance, and to keep contaminants and objects away from sensors 48, 50, some or all of windows 322 can be covered by a covering material 324 that transmits, advantageously with minimal loss, the type of energy used by the sensor 48, 50. For example, covering material 324 can be a transparent glass or plastic pane, a screen, or a lens.

The assembly of plug 222 and sensing unit is positioned within housing 320 so that a top surface 326 of housing unit 320 is positioned a predetermined distance from socket 24/224, which may be mounted, for example upon a ceiling, vertical wall, or floor. In FIG. 38, plug 222 includes a barrel 38 having threads 40 which extend from a central body 272 of plug 222. A threaded fastener, for example nut 42, can be threaded onto barrel 38 so that a lower surface 328 of housing 320 is clamped between nuts 42 to dispose plug 222 at the correct orientation with respect to housing 320.

In an embodiment, device 300 comprises only plug 222, sensing unit 26, and housing 320. Device 300 is releasably attachable using spindle 34 to a socket 224 mounted to the edifice. This assembly can then function to provide the sensing, communications, transmission, and other functions as described herein. These functions can include any or all of, for example, BLUETOOTH communication of information; WiFi communication, for example with a function of hub, router, access point, or relay; a motion sensor to detect movement, or an infrared sensor to detect the presence of humans or animals, useable for example to control an HVAC system or to provide input for an alarm or monitoring system; thermostat; camera for communication, or for an alarm or monitoring system; speaker; smoke detector; fire detector; occupancy detector using any of a variety of appropriate sensors, such as motion, infrared, audio, image detection, image recognition, or air pressure; humidity sensor, for example to protect art or identify leaks or water intrusion; and a power consumption meter to detect intrusion or to improve efficiency; and smoke and/or air quality sensors. Herein, for brevity, the term 'sensor' is used to collectively refer to any device which can carry out one or more of the foregoing functions, and it should therefore be understood that a 'sensor' herein can sense a condition, actuate, transmit, receive, both send and receive, or is otherwise configured to carry out any of the foregoing functions.

As shown in FIG. 38, a hanging lamp 400 is connected to a hickey type connector 402 threaded onto barrel 38. A supporting electrical wire 404 passes through an aperture 332 in housing 320, and is connected to plug central body 272 at connector channels 32. Push button 36 is accessible within connector 330 to release device 300 together with the hanging lamp. While a hanging lamp is illustrated, it should be understood that a floor lamp or wall sconce could be created in a like manner, although a rigid connection between device 300 and the lamp can be provided, as understood within the art. In these embodiments, socket 24/224 is mounted in the floor or wall, respectively. A chain or other tether can be provided together with wire 404 for heavier suspended devices, such as swag lamps. For certain applications, the chain or tether forms one or more conductors, as understood within the art.

Figure 41:
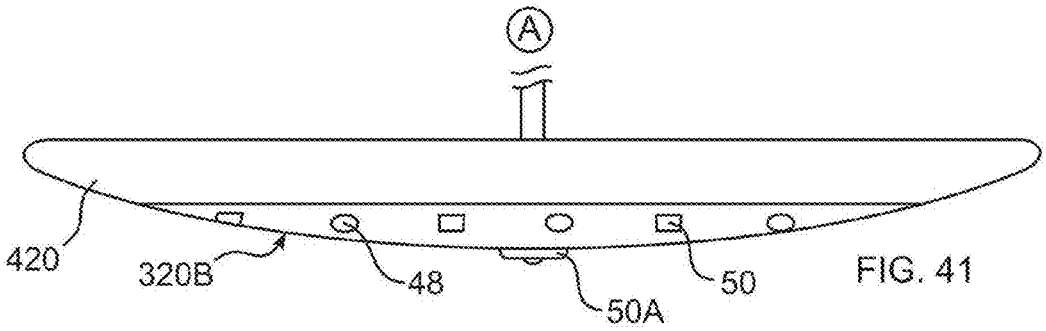
FIG. 41 depicts a lamp head of the disclosure, the lamp head including a plurality of sensors, the lamp head connectable to a cable of FIG. 40.

Turning now to FIGS. 39-41, in an embodiment of the disclosure, a fan, fan/light, or lamp head 420 includes a sensing unit 26. The lamp head 420 can form a housing 320B, which may be integral with a housing of lamp head 420, or a sensing unit 26 can connected to lamp head 420 to expose the sensors 48, 50 as required. In FIG. 41, a sensor/camera 50A is mounted on an underside of lamp head 420, useable for detecting occupancy, movement, intrusion, or communications, for example. A wide angle lens can be used to obtain coverage of an entire room or overlapping area. It is noted that the shapes of sensors 48, 50, 50A in the drawings are representative, typical, or arbitrary, and that sensors can have a wide variety of appearances, from not visible, to elongated, or any other shape. Further, sensors may be developed in the future which are useable in accordance with the disclosure and which may have a distinct appearance. Sensors may additionally extend from a surface of sensing unit 320, 320A, 320B, including for example an antenna or a movable camera.

In FIG. 39, central body 272 of plug 222 includes five connector channels 32, which include a ground, neutral, and line (hot) connector, and two connectors for a serial data connection. Accordingly, plug 222 includes at least five corresponding male concentric connector rings 378 as described in the incorporated references, and socket 224 likewise includes at least five female recesses 380 and terminals 382, all as shown, generally, in FIGS. 25 and 30. The basic functioning of the connector rings and female recesses are described in the incorporated references.

A low voltage signal generated by a remote device, such as a network switch or external sensor board power supply, or a connected device, such as board 52 and or sensor 48, 50, can be placed on a concentric connector ring 378 which protrudes from the plug 22, 222 or socket 24, 224 body, as it may be contacted by a person without potential for harm. In such embodiments, each of a mating set of socket 24, 224 and plug 22, 222 include extending conductor rings 378 and corresponding mating recesses 380.

If high voltage (e.g. 110 or 240*v*) is used for operation of the lamp head 420, there may be certain electrical code restrictions with respect to passing the serial data wires through the same raceway or conduit as the high voltage cables. In some instances, it is acceptable if all wires are separately housed in insulation which is rated for the same maximum voltage. In other cases, suitable barriers can be provided which separate the high and low voltage cables. Alternatively, it is possible to produce the lamp head 420 to operate at low voltage, particularly in light of available low voltage LED lighting, signal and power conductors could be placed within the same conduit and junction box. Alternatively, low and high voltage wires connected to socket 224 could be directed to separate raceways at the mounting location.

Two serial data conductors enable transmission of sensor data to and from sensors 48, 50, using any known protocol, including for example Firewire, USB, RS-485, or any other standard or proprietary format. In another embodiment, there are four serial data wire connections within plug 222 and socket 224, corresponding to the four conductors of a standard Ethernet CATS or 6 cable, or other cable configuration, such as CAT 7 or a hereinafter developed network cable standard. In this manner, socket 224 can be connected to standard Ethernet compatible hubs, switches, and routers, to form part of a local or wide area network, including a local LAN or the Internet. In a further embodiment, only four connections are provided upon plug 222 and socket 224, corresponding to a PoE (Power over Ethernet) connection, whereby both data and power for board 52 and lighting, if present, are carried by the Ethernet cable. In one embodiment, lamp head 420 is an emergency light which, together with other such lights, provides sufficient light to enable evacuation of the edifice in an emergency. It should be understood that plug 22/222 and socket 24/224 can be fabricated with any number of connections, and any combination of low voltage low power and high voltage higher power connectors as are needed, within space constraints and with regard to the safety and strength of the device.

In FIG. 40, housing 320A forms a canopy sufficiently large to house a centrally located supporting electrical wire 404, and a release lever 342. In the embodiment shown, release lever 342 rotates about pivot 344 to engage and depress button 36, to release plug 222. Other forms of release lever are shown and described in the incorporated references, and can alternatively be used in this embodiment. In the embodiment shown, a canopy shape is created by elongating sidewalls 348, and forming lower housing surface 350A to curve toward a center region. However, housing 320A can be provided in any shape for any particular purpose, including providing sufficient space for all components, for example housing components associated with the edifice, such as a protruding electrical box or other obstruction, or a retractable cord. Alternatively, or additionally, housing 320A has a shape that is selected for appearance.

Screws 328 support housing 320 with respect to sensing unit 26, the latter affixed to plug 222 by barrel 38, threads 40, and nuts 42. Alternatively, housing 320 can be affixed directly to barrel 38, or to plug 222 or sensing unit 26 by any other means, such as adhesive, press fit, or clips, for example. Lamp head 420 is shown hanging from the embodiment of FIG. 40 (via reference "A"), although as with other embodiments herein, the assembly of FIG. 40 can be arranged as a floor lamp or sconce.

Figure 42:
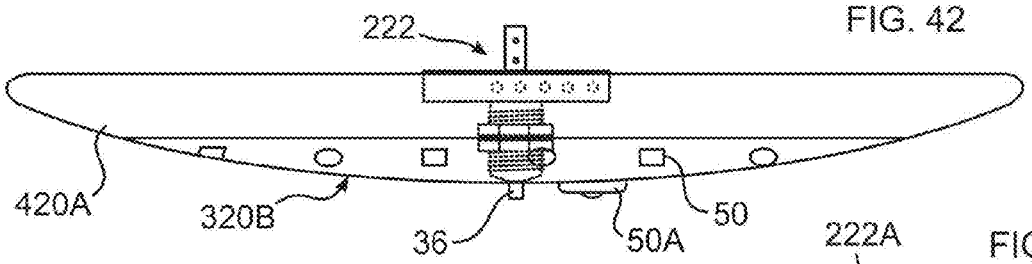
FIG. 42 depicts a lamp head as in FIG. 41, however a plug assembly as in FIG. 39 replaces a supporting wire.

With reference to FIG. 42, it may be seen that the lamp head 420A of FIG. 41 can be directly affixed to plug 222, for example by using nuts 42 as illustrated, with button 36 extending and accessible through an aperture in a housing 320 of lamp head 420A. Accordingly, camera 50A has been offset to enable a central clearance for button 36. Alternatively, a release lever 342 can be employed. Lamp head 420A can be used and configured as a floor lamp, ceiling lamp, or sconce. As with all embodiments herein, devices can be configured for indoor or outdoor used, advantageously incorporating appropriate seals, and using weather and UV rated materials.

Figure 43:
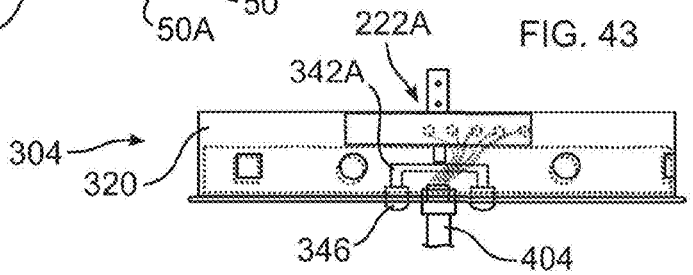
FIG. 43 depicts an assembly as in FIG. 39, however a two pronged release lever is provided, enabling a centrally disposed supporting wire.

FIG. 43 illustrates a device 304 of the disclosure which includes a low-profile housing 320 and a plug 222A having a shortened or truncated barrel 38, plug 222A otherwise including all of the components of plug 222 and functioning in a like manner as described herein and in the incorporated references. A two pronged release lever 342A spans a center of lower housing surface 350, enabling a central mounting for supporting electrical wire 404 or other centrally mounted object, such as a rigid lamp support. Two ends 346 extend through housing 320, and can be pressed by two fingers or a suitably configured tool, to press button 36 and release plug 222.

Figure 44:
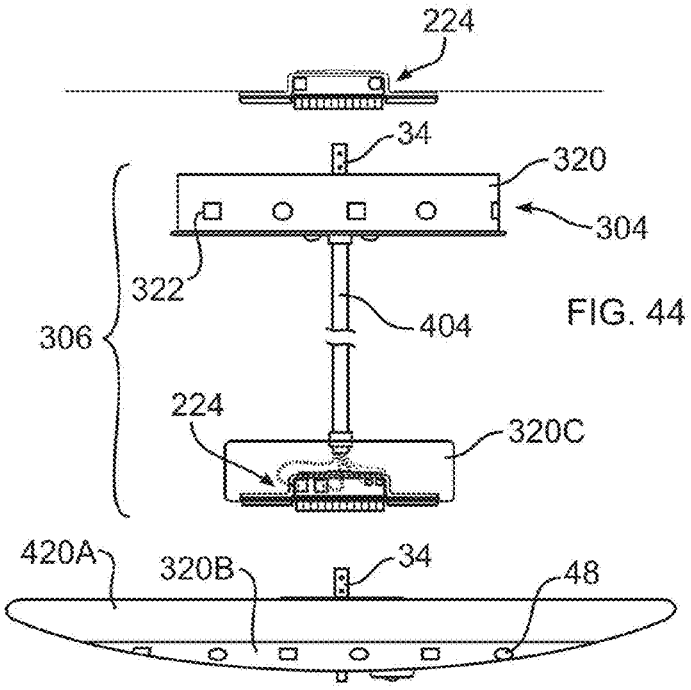
FIG. 44 depicts as assembly including a sensing assembly as in FIG. 43, and an extension housing enabling connection to a lamp head as in FIG. 42, the assembly of FIG. 44 thereby insertable between a socket and an electrical fixture having a plug of the disclosure.
Figure 45:
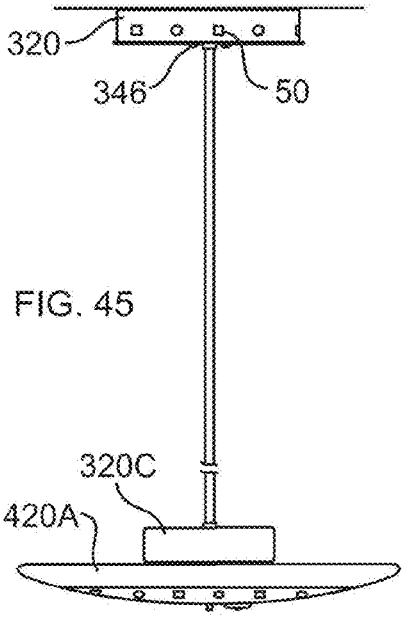
FIG. 45 depicts of the assembly of FIG. 44, connected to a socket and an electrical fixture.

FIG. 44 illustrates a device 306 formed as an assembly including device 304 and lamp head 420A. Other sensing and non-sensing devices of the disclosure, for example those of FIGS. 38-40 or others herein, could alternatively be used instead of device 304 to form device 306. In the embodiment of FIG. 44, a supporting electrical wire 404, or a rod or other attachment structure, extends from housing 320 and is affixed to an extension housing 320C at a distance from housing 320. Extension housing 320C contains a plug 224, whereby a lamp head 420A such as is shown in FIG. 42 can be connected, or any other device including a plug 222. The completed assembly, at a reduced scale, is shown in FIG. 45. As such, an assembly 306 including a plug 222, sensor unit 26, supporting electrical wire 404 or other extension, and extension housing 320C forms an integral unit that can be installed between any device having a plug 222 and any socket 224. In so doing, a sensor array can be used to not only provide a sensor unit, but to change or extend a location of a connected device. Further the lamp head can be exchanged for an alternate device to suit an intended use for an area, or to update or redecorate. Additionally, devices 306 can be daisy-chained, or connected one to another, to provide additional or redundant features.

In FIG. 46, extension housing 320E is configured to include sensors as shown and described with respect to device 300 or 304, for example. More particularly, a sensing board 52 can be provided within housing 320E, or board 52 can be provided in another component, and sensors 48, 50 are connected by wires to a remote sensing board 52. In the embodiment shown, wires 386 connect sensors 48, 50 to board 52, and wires 388 carry a processed or pre-processed signal through wire 404 to be used elsewhere, as described herein. Accordingly, the embodiment of FIG. 46 provides for a socketed or female extension device which can position sensors proximate any electrical fixture having a plug 24, 224 as described herein, regardless of whether or not the electrical fixture has incorporated sensors, such as are shown in FIG. 41 or 42, for example.

While the embodiment of FIG. 42 is shown connected to device 306 which includes a sensing unit 26, a conventional lamp, fan, or fan/light, or any other device provided with plug 222 can be connected. Similarly, extension housing 320E can be provided, as shown in FIG. 46, and a conventional lamp 424 or other extended device can be additionally be connected to an assembly such as is shown in FIG. 39, 40, or 43, or other device of the disclosure that includes sensors 48, 50. Alternatively, where extension housing 320E is provided, an additional sensor assembly can be omitted. FIG. 47 further illustrates that sensors 48, 50, 50A can be disposed additionally or solely upon lower housing surface 350 of any housing 350 or 350A-E, herein.

Turning now to FIG. 48, a fan/light device 308 includes a canopy or housing 320D which includes a gimbal support 426. As illustrated adjacent to device, a plug 222 is mounted inside canopy 320D to be connectable to a socket 224 mounted to a wall, ceiling, or floor. An extension rod 362 is slideably supported within device 308 to contact button 36, and includes a distal end 364 which is pushable to disconnect plug 222 from a socket 224. Various alternative embodiments of such extension push-rods are discussed in the incorporated references.

A light cover 366 is removable to reveal distal end 364, which can be pushed when it is desired to release device 308. Light cover 366 includes a lens 368 which visibly obscures sensors 48, 50, but enables transmission of energy to and from the sensors/transmitters/receivers. Alternatively, lens 368 can be transparent, or can be transparent in a small location, for example to enable a visible light camera to obtain images. A sensor board 52 can be located under light cover 366, within fan body 428, or within canopy 320D.

Devices of the disclosure equipped with sensing units 26 can form part of a "smart home" architecture and operation, such as are made by GE and other companies. Accordingly, board 52 can be provided with electronic circuitry, including an electronic processor, memory, storage, and other components which can enable programming and remote operation associated with such a function. Remote operation can include a central programming or control program which controls the functioning of a device of the disclosure. This can include, for example, control from a website, or control from an app executing upon a smartphone or tablet. Alternatively, a handheld TV/DVR style remote control device can be used.

Devices of the disclosure can include one more sensors which can function as any or all of intelligent thermostats, intelligent hazard-detection unit, intelligent entryway-interface device, smart switch, including smart wall-like switches, smart utilities interface or interface to other service, such as smart wall-plug interface, and a wide variety of intelligent, multi-sensing, network-connected appliances, including refrigerators, televisions, washers, dryers, lights, audio systems, intercom systems, mechanical actuators, wall air conditioners, pool-heating units, irrigation systems, and many other types of intelligent appliances and systems.

Devices of the disclosure can include one or more different types of sensors, one or more controllers and/or actuators, and one or more communications interfaces that connect the smart-home devices to other smart-home devices, routers, bridges, and hubs within a local smart-home environment, various different types of local computer systems, and to the Internet, through which a smart-home device may communicate with cloud-computing servers and other remote computing systems. Data communications can be carried out by sensors 48, 50 and board 52 using any of a large variety of different types of communications media and protocols, including wireless protocols, such as Wi-Fi, ZigBee, 6LoWPAN, various types of wired protocols, including CAT6 Ethernet, HomePlug, and other such wired protocols, and various other types of communications protocols and technologies. Devices of the disclosure can integrate with each other, or with previously known so-called 'smart-home' devices, and may themselves operate as intermediate communications devices, such as repeaters, for smart-home devices and other devices of the disclosure. A smart-home environment including devices of the disclosure can additionally include a variety of different types of legacy appliances and devices which lack communications interfaces and processor-based controllers.

All references cited herein are expressly incorporated by reference in their entirety. It will be appreciated by persons skilled in the art that the present disclosure is not limited to what has been particularly shown and described herein above. In addition, unless mention was made above to the contrary, it should be noted that all of the accompanying drawings are not to scale. There are many different features to the present disclosure and it is contemplated that these features may be used together or separately. Thus, the disclosure should not be limited to any particular combination of features or to a particular application of the disclosure. Further, it should be understood that variations and modifications within the spirit and scope of the disclosure might occur to those skilled in the art to which the disclosure pertains. Accordingly, all expedient modifications readily attainable by one versed in the art from the disclosure set forth herein that are within the scope and spirit of the present disclosure are to be included as further embodiments of the present disclosure.

DRAWING REFERENCES 20 quick connect device
22 plug
24 socket
26 sensing unit
28 pins (extending from plug)
30 receptacles (in sensor unit)
32 channel (in plug)
34 spindle assembly
36 push button (of plug)
38 barrel (of plug)
40 threads (barrel)
42 nut
44 locking washer
46 mounting strap
48 sensor (receiver, or other sensor type)
50 sensor (transmitter, or other sensor type)
50A camera or sensor
52 sensing board
54 low voltage power generation circuit
56 control circuit
58 high voltage AC control circuit
60 slots
62 double locking mechanism
94 barrel
96 lower threaded portion (of barrel)
100 spindle assembly
116 push rod
124 fan socket
132 mounting strap
134 aperture
136 flanges
138 screw
140 arcuate outer curvature
142 edge (curvature)
144 track
146 screw
152 long push rod
152' long push rod
156 guide barrel
220 quick connect device
222 plug
224 socket
226 electrical fixture
228 electrical junction box
230 teeth
232 mounting strap
234 aperture
236 flanges
238 screw
240 face plate
242 rim
244 cut out
248 resilient tabs
250 face plate centerpiece
252 peripheral edge
254 post
256 central bore
260 top surface (plug)
272 central body (plug)
300 device assembly -continued 304 device assembly
306 device assembly
308 fan/light device
320, 320A, 320B housing
320C extension housing
320D fan housing
322 window (in housing)
324 window covering material
326 top surface (of housing)
330 connector
342 release lever
342A two prong release lever
344 release lever pivot
346 release lever ends
348 housing sidewall
350, 350A lower housing surface
362 extension rod
364 extension rod distal end
366 light cover
368 light cover lens
404 supporting electrical wire
420 fan, fan/light, or lamp head
424 conventional lamp
426 gimbal support
428 fan body
500 canopy
502 aperture
504 supporting extension
504a-504e extension embodiments
506 coupler
508 aperture (extension)
510 rod cap
512 quick link
514 shoulder (canopy)
516 ring
518 electrical wires
520 aperture
522 aperture
524 grommet

What is claimed is:

1. A device for connecting an electrical fixture with electrical power supply wiring, and for mounting the fixture on a support, comprising:

a socket including a socket body having at least one internal cavity therein;

an electrically conductive contact terminal disposed within the cavity for establishing an electrical connection between the electrical power supply wiring and the socket;

a plug rigidly fixed to the fixture and insertable into the socket, the plug having at least one male connector electrically connected to the fixture and engageable with the contact terminal within the socket to establish a circuit between the electrical fixture and the electrical power wiring;

a releasable latch carried on the combination of the plug and the socket for releasably mounting the fixture on the support; and a sensing unit for wirelessly communicating a sensed condition away from the device and wirelessly receiving a signal, the sensing unit coupled to the socket, the fixture replaceable together with the plug using the releasable latch to associate the sensing unit and socket with a different fixture, wherein wirelessly communicating includes communicating using at least one of Bluetooth, WiFi, and RF and wirelessly receiving includes receiving using at least one of Bluetooth, WiFi, and RF and wherein wirelessly communicating includes communicating with an apparatus using a digital communication protocol to thereby serve as a hub, router, access point, or relay for the apparatus.

2. The device of claim 1, wherein the sensing unit is electrically coupled to the socket.

3. The device of claim 2, wherein the sensing unit is mechanically coupled to the socket.

4. The device of claim 2, wherein the circuit between the electrical fixture and the electrical power wiring is established through the sensing unit.

5. The device of claim 1, wherein the sensing unit wirelessly communicates a sensed condition using WiFi.

6. The device of claim 5, wherein the sensing unit wirelessly receives a signal using Bluetooth.

7. The device of claim 6, wherein the signal is a command signal to control the device and/or the associated electrical fixture.

8. The device of claim 7, wherein the command signal results from the sensed condition.

9. The device of claim 7, wherein the command signal is independent of the sensed condition.

10. The device of claim 1, wherein the sensing unit wirelessly receives a signal using WiFi.

11. The device of claim 10, wherein the signal is a command signal to control the device and/or the associated electrical fixture.

12. The device of claim 1, wherein the sensing unit includes a transmitting sensor for receiving at least one of an RF, Wi-Fi, and Bluetooth sensor.

13. The device of claim 1, wherein the sensing unit includes an environmental sensor for determining an environmental condition.

14. The device of claim 13, wherein the environmental condition includes at least one of temperature, humidity, smoke, carbon monoxide, motion, and presence.

15. The device of claim 1, wherein the sensing unit includes a security sensor.

16. The device of claim 15, wherein the security sensor includes at least one of a security camera, glass breakage detector, motion/presence detector, and/or emergency lighting.

17. The device of claim 1, wherein the plug has a plurality of teeth and the socket has a plurality of teeth, the plurality of teeth of the plug engaging with the plurality of teeth of the socket to limit relative rotational movement of the plug and socket.

18. The device of claim 17, wherein the plurality of teeth of the plug and the plurality of teeth of the socket are located on opposing faces.

19. The device of claim 17, wherein the plurality of teeth of the plug is located on the circumference of the plug and the plurality of teeth of the socket is located on the circumference of the socket.

20. A plug for coupling with a socket for a device for connecting an electrical fixture with electrical power supply wiring, and for mounting the fixture on a support, the plug rigidly fixable to the fixture and comprising:

at least one male connector electrically connected to the fixture and engageable with a contact terminal within the socket to establish a circuit between the electrical fixture and the electrical power wiring;

a releasable latch carried on the combination of the plug and the socket for releasably mounting the fixture on the support; and a sensing unit for at least one of wirelessly communicating a sensed condition and wirelessly receiving a signal, the sensing unit electrically coupled to at least one of the plug and socket, wherein the fixture is replaceable together with the plug using the releasable latch to associate the sensing unit and plug with a different socket, wherein wirelessly communicating includes communicating using at least one of Bluetooth, WiFi, and RF and wirelessly receiving includes receiving using at least one of Bluetooth, WiFi, and RF, and wherein wirelessly communicating includes communicating with an apparatus using a digital communication protocol to thereby serve as a hub, router, access point, or relay for the apparatus.

21. A device for connecting an electrical fixture, comprising:

a first electrical plug including: a plug body; a plurality of concentric conductive rings connected to the body; a cylindrical post extending along an axis defined by the concentric rings, the post including an axially extending channel and at least one radially extending shaft housing a retaining ball; a plunger movable within the axially extending channel and having a radial profile which pushes the retaining ball to protrude from the axially extending channel in a first position, and which enables the retaining ball to retract into the channel to not protrude in a second position;

at least one sensor electrically connected to at least one concentric conductive ring of the plug for wirelessly communicating a sensed condition using at least one of Bluetooth, WiFi, and RF and wirelessly receiving a signal using at least one of Bluetooth, WiFi, and RF;

an electrical wire having a plurality of conductors, the wire defining proximal and distal opposing ends, a conductor electrically connected to at least one of the concentric conductive rings at the proximal end; and an extension housing connected to the distal end of the conductor, the housing including a socket mateable with a second electrical plug as defined with respect to the first electrical plug, when a second electrical plug is inserted into the socket, the socket including: a channel sized to receive the cylindrical post of the second electrical plug, the channel defining a portion having a radius less than a radius defined by the post and a protruding retaining ball, the channel defining a portion have a radius that is not less than a radius defined by the post and a protruding retaining ball; a plurality of concentric channels mateable with the plurality of concentric rings; a plurality of electrical terminals each disposed proximate a concentric channel and positioned to electrically contact one of the concentric conductive rings when the concentric ring is mated within a concentric channel, at least one of the electrical terminals connected to a conductor of the electrical wire, and wherein wirelessly communicating includes communicating with an apparatus using a digital communication protocol to thereby serve as a hub, router, access point, or relay for the apparatus.

* * * * *